US007497106B2

(12) United States Patent
Beining

(10) Patent No.: US 7,497,106 B2
(45) Date of Patent: Mar. 3, 2009

(54) CRIMPING APPARATUS WITH A SUPPORT STRUCTURE INCLUDING FIRST AND SECOND PORTIONS

(75) Inventor: Michael Paul Beining, Holland, OH (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/353,383

(22) Filed: Feb. 14, 2006

(65) Prior Publication Data

US 2007/0186616 A1 Aug. 16, 2007

(51) Int. Cl.
*B21J 7/14* (2006.01)

(52) U.S. Cl. ..... 72/402; 72/413; 72/482.93

(58) Field of Classification Search ..... 72/402, 72/413, 409.16, 480, 446, 448, 481.1, 481.3, 72/482.92, 482.93

See application file for complete search history.

(56) References Cited

U.S. PATENT DOCUMENTS

| | | | | | |
|---|---|---|---|---|---|
| 1,322,584 | A | | 11/1919 | Kraft | |
| 1,818,435 | A | | 8/1931 | Smith et al. | |
| 1,890,016 | A | | 12/1932 | Smith et al. | |
| 2,182,663 | A | | 12/1939 | Eby et al. | |
| 2,703,925 | A | | 3/1955 | Peck | |
| 2,746,327 | A | * | 5/1956 | Runde | 72/409.16 |
| 3,568,495 | A | * | 3/1971 | Duffield | 72/402 |
| 3,731,518 | A | | 5/1973 | Blocher | |
| 3,851,514 | A | | 12/1974 | Chen et al. | |
| 4,034,592 | A | | 7/1977 | Chen et al. | |
| 4,250,607 | A | | 2/1981 | Lillbacka et al. | |
| 4,306,442 | A | | 12/1981 | Schröck | |
| 4,472,959 | A | * | 9/1984 | Fencl | 72/402 |
| 4,527,414 | A | | 7/1985 | Jurkovic et al. | |
| 4,641,516 | A | * | 2/1987 | Satoh | 72/482.93 |
| 4,766,808 | A | | 8/1988 | Schröck | |
| 4,774,828 | A | | 10/1988 | Schröck | |
| 4,989,443 | A | | 2/1991 | Sawdon | |
| 5,092,152 | A | | 3/1992 | Miller et al. | |
| 5,228,326 | A | | 7/1993 | Wasilko et al. | |
| 5,243,846 | A | | 9/1993 | Davis et al. | |
| 5,257,525 | A | * | 11/1993 | Clarke | 72/402 |
| 5,307,664 | A | | 5/1994 | Homm | |

(Continued)

FOREIGN PATENT DOCUMENTS

DE 198 42 765 A1 3/2000

(Continued)

OTHER PUBLICATIONS

Aeroquip ProCrimp™ 1390 Crimp Machine, Operator's Manual, 1996, 16 pages.

(Continued)

*Primary Examiner*—Dana Ross
*Assistant Examiner*—Debra M Sullivan
(74) *Attorney, Agent, or Firm*—Pearne & Gordon LLP

(57) ABSTRACT

A crimping apparatus is provided for use with a crimping machine. The crimping apparatus comprises a support structure including a first portion and a second portion. The second portion is configured to engage the first portion to define an axial passage into an interior area of the crimping apparatus. The second portion is configured to be moved completely out of engagement with the first portion to selectively define an alternative passage into the interior area of the crimping apparatus.

15 Claims, 16 Drawing Sheets

U.S. PATENT DOCUMENTS

| | | | | |
|---|---|---|---|---|
| 5,323,697 | A * | 6/1994 | Schrock | 100/232 |
| 5,353,623 | A | 10/1994 | Bobenhausen | |
| 5,644,945 | A | 7/1997 | Baldwin et al. | |
| 5,649,445 | A * | 7/1997 | Lavoie et al. | 72/413 |
| 6,257,042 | B1 | 7/2001 | Välimäki et al. | |
| 6,484,552 | B1 | 11/2002 | Bernas et al. | |
| 6,519,998 | B2 * | 2/2003 | Ertl et al. | 72/402 |
| 2005/0061052 | A1 * | 3/2005 | Schrock et al. | 72/402 |

FOREIGN PATENT DOCUMENTS

| | | | |
|---|---|---|---|
| DE | 200 17 791 | U1 | 2/2001 |
| DE | 199 58 103 | C1 | 3/2001 |
| JP | 57109536 | A | 7/1982 |
| WO | WO 02/47840 | A2 | 6/2002 |

OTHER PUBLICATIONS

Aeroquip FT1390 Die Cage Operator's Manual, Sep. 2000, 7 pages.

Aeroquip ProCrimp® 1370 Crimp Machine, Operator's Manual, Mar. 2001, 10 pages.

Crimp Your Gates Couplings with Confidence on your UNIFLEX Crimper, Gates® Catalog, Nov. 2003, 2 pages.

Portable T-480-HP Crimping Procedure, Eaton Weatherhead Hose Assembly Master Catalog W-HYOV-MC002-E, Nov. 2003, pp. 338-342.

Eaton Aeroquip, Fluid Conveyance Products, Master Catalog, Jan. 2005, Cover page, inside cover, and pp. 327-331.

Finn-Power® Swaging & Crimping, Finn Power Quick Change Tools, 2 pages, 2004.

Special Machines—HM 490, Uniflex, 3 pages (printed Jan. 9, 2006).

Special Machines—HM 500, HM 502, Uniflex, 3 pages (printed Jan. 9, 2006).

Customcrimp® Standard and Special Series Dies, catalog, 2 pages (Jan. 9, 2006).

U.S. Appl. No. 11/353,731, filed Feb. 14, 2006.

U.S. Appl. No. 11/751,258, filed May 21, 2007.

* cited by examiner

CRIMPING APPARATUS WITH A SUPPORT STRUCTURE INCLUDING FIRST AND SECOND PORTIONS

FIELD OF THE INVENTION

The present invention relates to crimping apparatus, and more particularly, to crimping apparatus with a support structure including first and second portions.

BACKGROUND OF THE INVENTION

Conventional die cage assemblies are known to be used with a crimping machine to crimp a fitting on an end of a hose. For example, a die cage assembly may be used with a Pro-Crimp™ 1390 crimping machine available from Eaton Aeroquip Inc. of Maumee, Ohio. Such a crimping machine may be used with various die cage assemblies. Die cage assemblies can be convenient to properly align die segments with respect to the crimping machine. Moreover, die cage assemblies can also provide a unitary structure that simplifies carrying and installation of the die segments by an operator setting up the crimping machine. Examples of die cage assemblies are disclosed by U.S. Pat. No. 6,484,552 which is incorporated by reference herein in its entirety. Die cage assemblies of U.S. Pat. No. 6,484,552 include a hinge portion to provide an alternate passage into an interior area of the die cage assembly. The alternate passage is designed to allow passage of large elbow hose fittings that could not pass through the central bore of a conventional die cage assembly. There is a continuing need to provide die cage assemblies that allow passage of oversized elements into the interior area of the die cage assembly for subsequent crimping with a crimping machine.

SUMMARY OF THE INVENTION

Accordingly, it is an aspect of the present invention to obviate problems and shortcomings of conventional die cage assemblies.

In accordance with one aspect, a crimping apparatus is provided for use with a crimping machine. The crimping apparatus comprises a support structure including a first portion and a second portion. The second portion is configured to engage the first portion to define an axial passage into an interior area of the crimping apparatus. The second portion is configured to be moved completely out of engagement with the first portion to selectively define an alternative passage into the interior area of the crimping apparatus.

In accordance with another aspect, a crimping apparatus for use with a crimping machine is provided. The crimping apparatus includes a support structure including a first portion and a second portion. The first portion comprises a first rear member attached to a first front member. The second portion comprises a second rear member attached to a second front member. The first front member is configured to engage the second front member to define an axial passage into an interior area of the crimping apparatus. The second portion is configured to be moved completely out of engagement with the first portion to selectively define an alternative passage into the interior area of the crimping apparatus.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
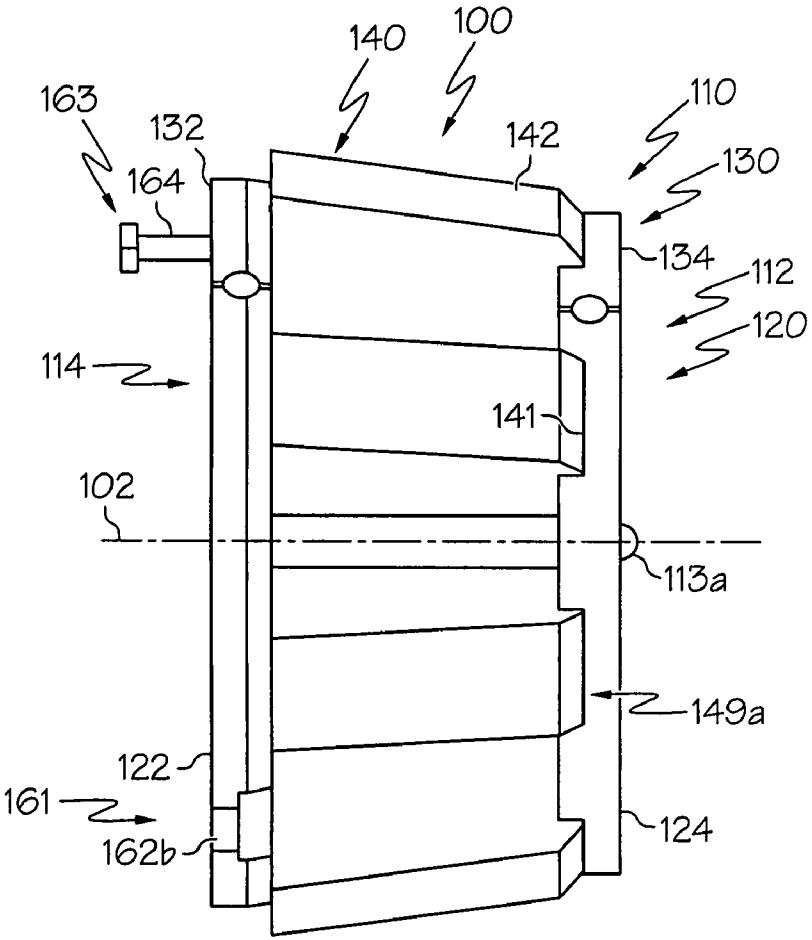
FIG. 1 is a side elevational view of one example of a crimping apparatus in accordance with aspects of the present invention.

Certain terminology is used herein for convenience only and is not to be taken as a limitation on the present invention. Further, in the drawings, the same reference numerals are employed for designating the same elements.

In accordance with aspects of the present invention, a crimping apparatus is provided for use with a crimping machine. One example of a crimping apparatus 100 incorporating aspects of the present invention is illustrated in FIGS. 1-4. The crimping apparatus 100 includes a support structure 110 and a plurality of die members 140 movably attached to the support structure 110.

Figure 3:
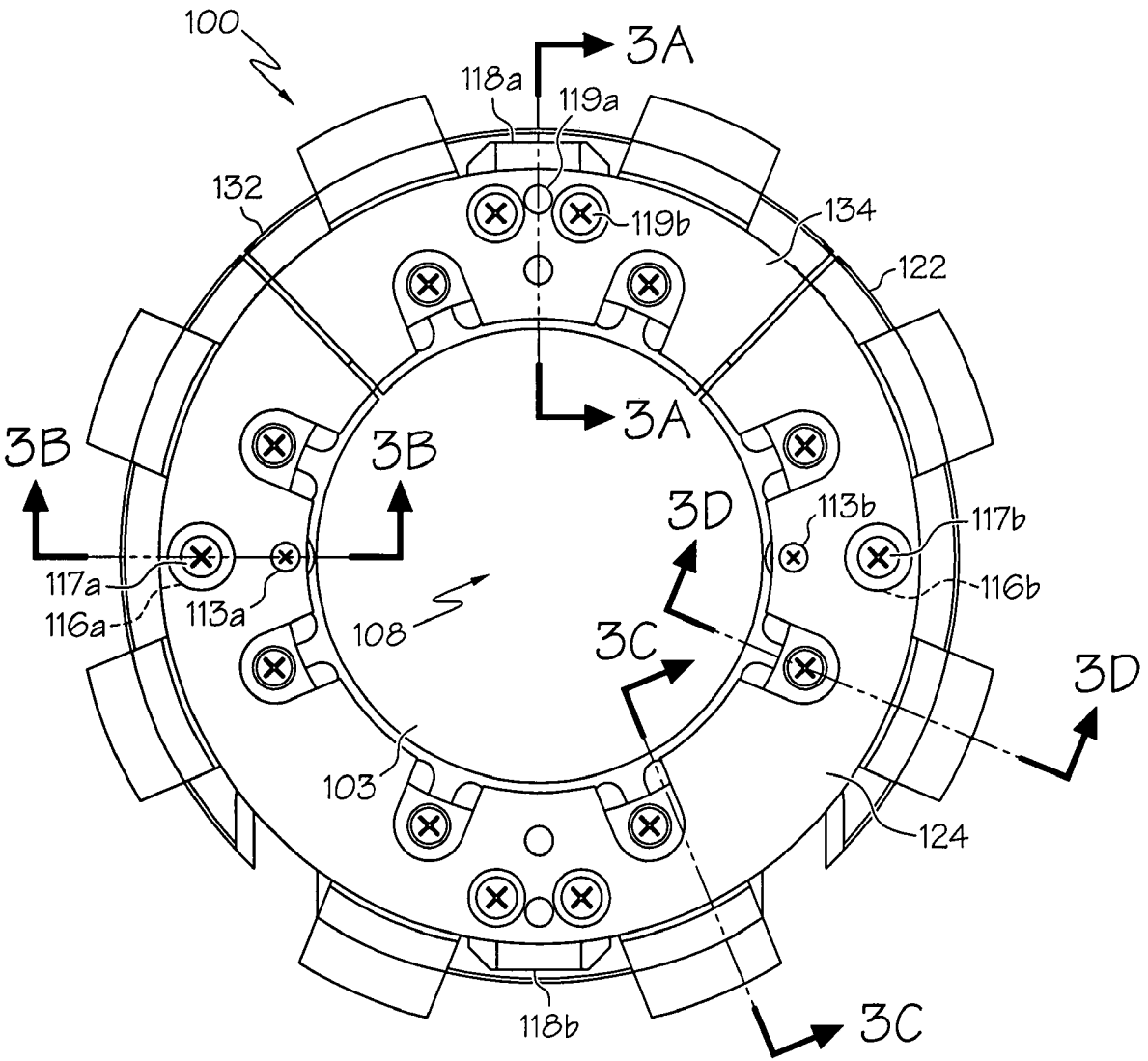
FIG. 3 is a front view of the crimping apparatus of FIG. 1.
Figure 3A:
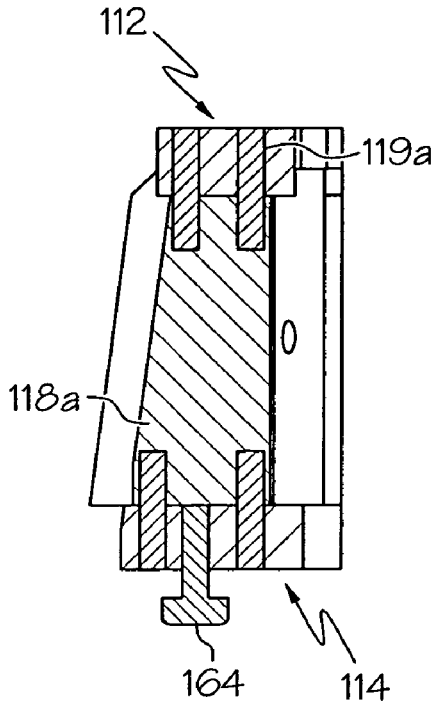
FIG. 3A is a sectional view of the crimping apparatus taken along line 3A-3A of FIG. 3.
Figure 3B:
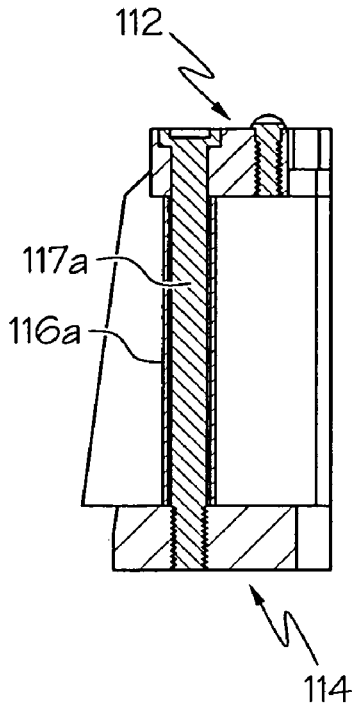
FIG. 3B is a sectional view of the crimping apparatus taken along line 3B-3B of FIG. 3.

Although not required, examples of support structures 110 can include a front member 112 and a rear member 114 that is attached, such as fixedly attached, to the front member 112. For instance, one or more spacers may be used to attach the rear member to the front member. Spacers can comprise a wide range of structures configured to provide attachment between the front and rear member. For example, as shown, the spacers can comprise one or more spacer blocks 118*a*, 118*b* and/or spacer tubes 116*a*, 116*b* positioned between at least portions of the front and rear member. In further examples, such spacers may be radially arranged about an axis 102 of the crimping apparatus in a wide variety of patterns. In one example, a pair of the spacers may be diametrically opposed to one another. As shown in FIGS. 1, 3 and 3B, the spacers can comprise a pair of diametrically opposed spacer tubes 116*a*, 116*b*. Features of the first spacer tube 116*a* are illustrated in the cross section of FIG. 3B wherein the second spacer tube 116*b* may include identical features. Each spacer tube 116*a*, 116*b* may be provided with a fastener that extends through the interior of the tube 116*a*, 116*b* to attach the front member 112 to the rear member 114. A wide variety of fasteners may be used such as a screw, nut and bolt combination, or the like. In the illustrative example shown in FIG. 3B, a screw 117*a* can be inserted through the spacer tube 116*a* to fasten the front member 112 to the rear member 114. Likewise, a similar screw 117*b* may be provided to extend through the spacer tube 116*b*.

In addition, or alternatively, the spacers can comprise one or more spacer blocks to enhance the structural integrity of the support structure. For example, as shown in FIGS. 3 and 3A, the spacers can comprise a pair of diametrically opposed spacer blocks 118*a*, 118*b*. Features of the first spacer block 118*a* are illustrated in the cross section of FIG. 3A wherein the second spacer block 118*b* may include identical features. Each end of the spacer block 118*a*, 118*b* can include one or more alignment pins 119*a* and one or more screws 119*b*. For example, one or more alignment pins 119*a* can be provided to help position the front member 112 and the rear member 114 with respect to each corresponding end of the spacer blocks. Moreover, one or more screws 119*b* may be provided to attach the front member 112 and the rear member 114 to each corresponding end of the spacer blocks.

Figure 4:
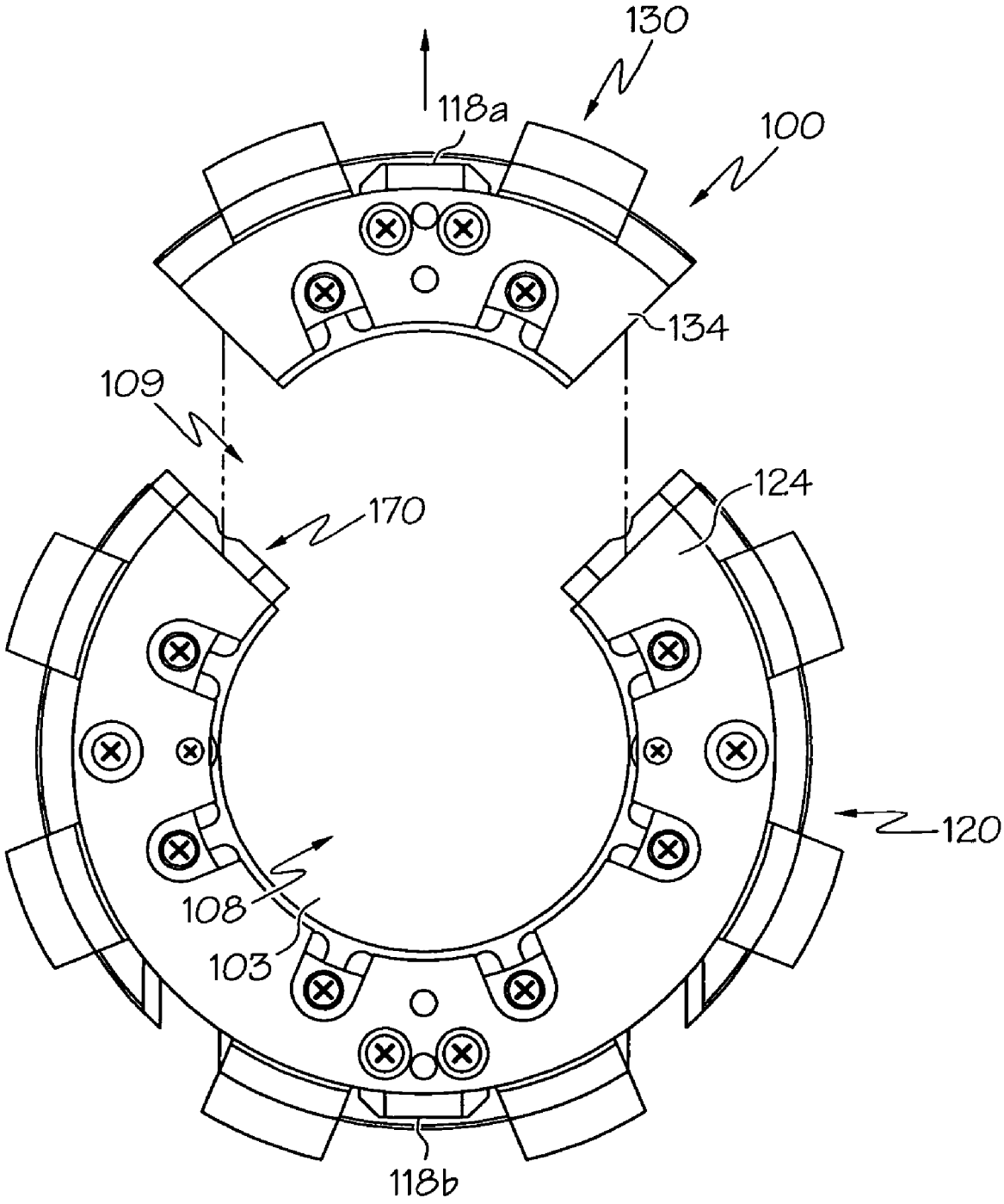
FIG. 4 is a front view of the crimping apparatus of FIG. 1 with a first portion and a second portion, wherein the second portion is moved completely out of engagement with the first portion.

Examples of crimping apparatus in accordance with the present invention include a support structure with two or more portions that cooperate to provide the crimping apparatus. For instance, as shown, the support structure 110 can include a first portion 120 and a second portion 130. The second portion 130 can engage the first portion 120 to define an axial passage 108 into an interior area 103 of the crimping apparatus 100. As shown in FIG. 4, the second portion 130 can also be configured to be moved completely out of engagement with the first portion 120 to define an alternative passage 109 into the interior area 103. The alternative passage 109 can be designed to accommodate various elements that, due to the size and/or shape of the elements, might not otherwise be introduced into the interior area 103 by way of the axial passage 108. In the illustrated embodiment, the first and second portions 120, 130 are each designed to include at least one die member 140 movably attached thereto. Although not shown, in further examples, one of the portions 120, 130 may be provided without any of the die members. In still further examples, one of the portions 120, 130 may be provided with all of the die members.

Figure 2:
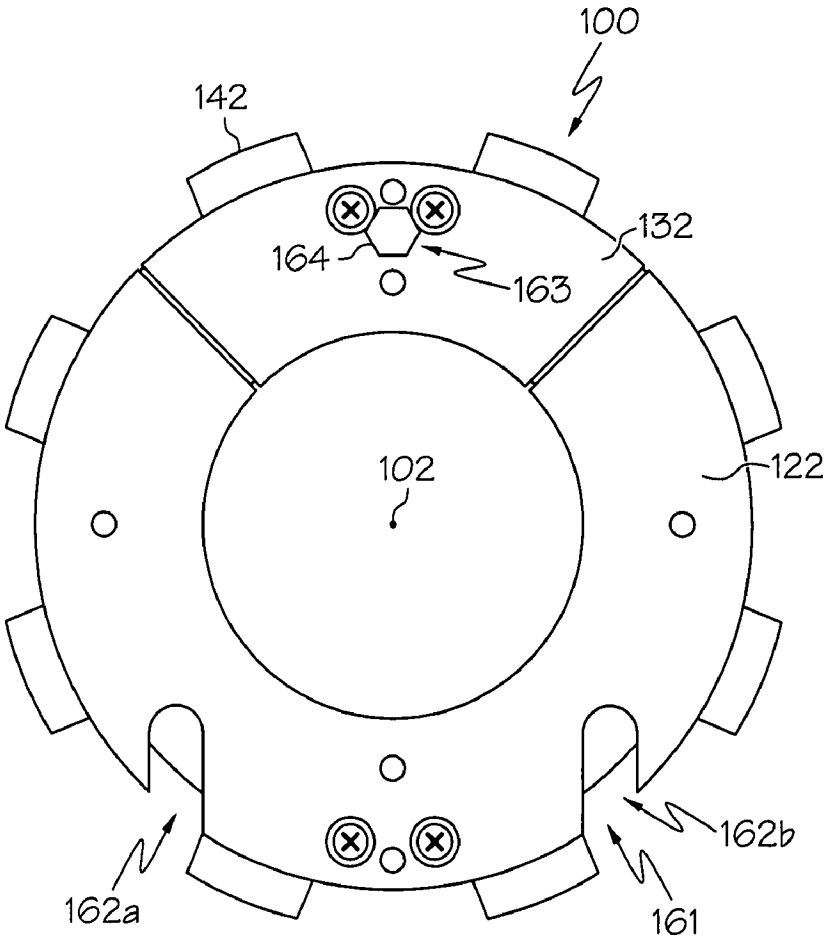
FIG. 2 is a rear view of the crimping apparatus of FIG. 1.
Figure 5:
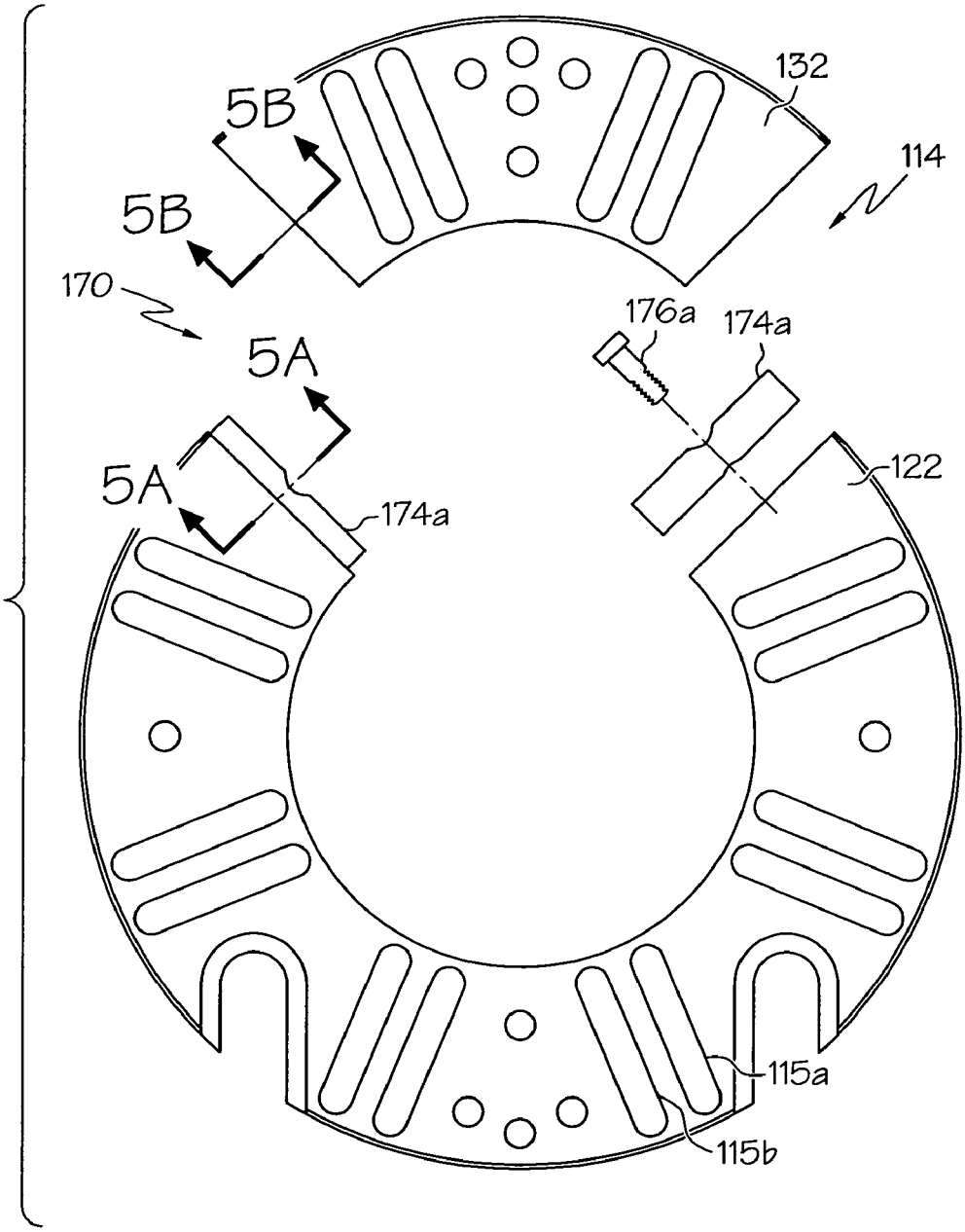
FIG. 5 is a front view of the rear member of the support structure.

Various structural arrangements may be provided to create the first and second portions 120,130. For example, as shown in FIGS. 1, 3, 4, and 6, the front member 112 can be provided a first front member 124 and a second front member 134. As shown in FIGS. 1, 2, and 5, the rear member 114 can be provided with a first rear member 122 and a second rear member 132. The first portion 120 can be assembled with the first rear member 122 attached, such as fixedly attached, to the first front member 124 while the second portion 130 can be assembled with the second rear member 132 attached, such as fixedly attached, to the second front member 134.

In further examples, the crimping apparatus can also include an optional registration structure to facilitate a predetermined orientation between the first and second portions 120, 130 of the support structures 10. Various portions of the crimping apparatus 100 can comprise the registration structure. For example, the front member 112 and/or the rear member 114 of the support structure 110 can be provided with one or more registration structures. Various types of registration structures may also be used in accordance with aspects of the present invention. In one example, the registration structure can comprise an alignment plate mounted to one side of the front and/or rear member to provide registration between the first and second portions. In the illustrated example, the registration structure can comprise a tongue and groove 170 structure although other registration structures may be provided in further examples.

Figure 5A:
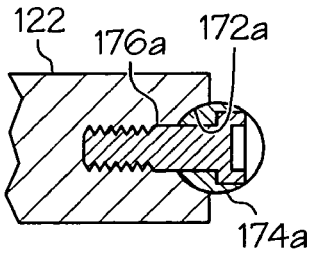
FIG. 5A is a sectional view of the rear member taken along line 5A-5A of FIG. 5.
Figure 5B:
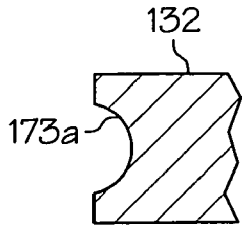
FIG. 5B is a sectional view of the rear member taken along line 5B-5B of FIG. 5.

Many different structural arrangements may provide a tongue and groove structure. For example, the tongue and/or groove may be machined from portions of the crimping apparatus such that the tongue and/or groove are integral with the structure. In the illustrated example, opposed grooves 172*a*/173*a*, 172*b*/173*b* are machined into abutting locations of the first and second portions 120, 130. Another piece, e.g., a registration pin 174*a*, 174*b*, may be fastened to one of the grooves to define the tongue portion. For instance, as shown in FIG. 5, the rear member 114 comprises two tongue and groove structures 170 that are each defined by a registration pin 174*a* and two grooves 172*a*, 173*a* adapted to each simultaneously receive portions of the registration pin 174*a*. Indeed, as shown in FIGS. 5, 5A, and 5B, each tongue and groove structure 170 comprises a groove 172*a* defined in the first rear member 122 and a groove 173*a* defined in the second rear member 132. A registration pin 174*a* can be mounted with respect to one of the grooves 172*a*, 173*a*. Mounting of the registration pin 174*a* may be provided by a fastener, adhesive, welding and/or other mounting structures. In the illustrated example, a screw 176*a* can be provided to extend through a counterbore in the registration pin 174*a* to mount the registration pin 174*a* with respect to the first rear member 122. Once mounted, a portion of a corresponding registration pin 174*a* longitudinally extends within the corresponding groove 172*a* defined in the first rear member 122. Another portion of each corresponding registration pin 174*a* extends out of the corresponding groove 172*a* to define the tongue portion of the tongue and groove structure 170. The tongue portion is configured to be received in a corresponding groove 173*a* defined in the second rear member 132. Therefore a predetermined orientation may be achieved between the first and second rear members 122, 132 by way of one or more tongue and groove structures 170 and/or other registration structures.

Figure 6:
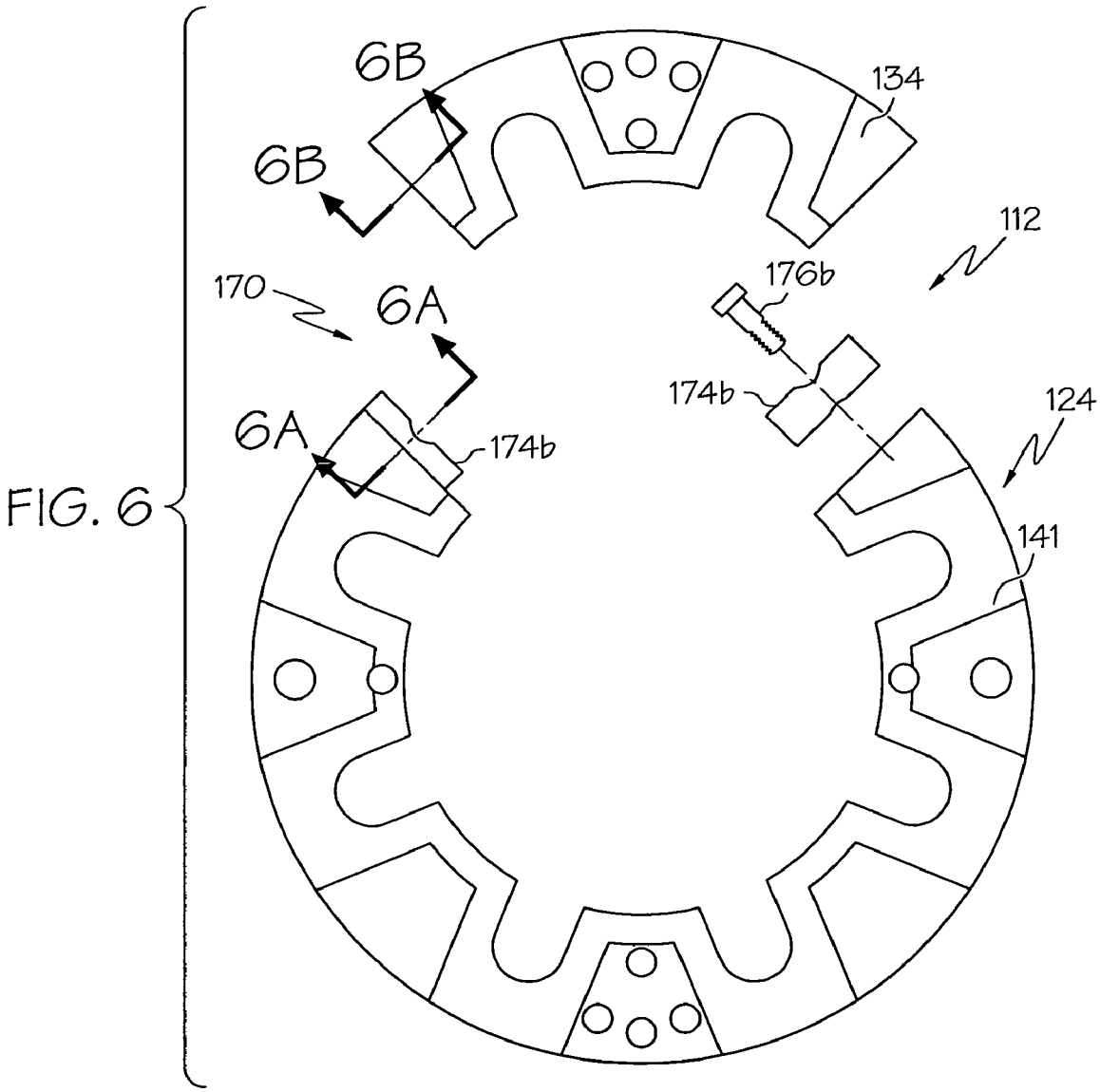
FIG. 6 is a rear view of the front member of the support structure.
Figure 6A:
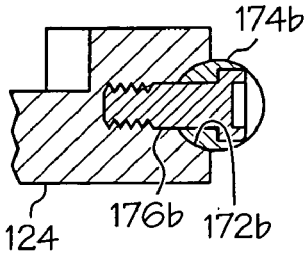
FIG. 6A is a sectional view of the front member taken along line 6A-6A of FIG. 6.
Figure 6B:
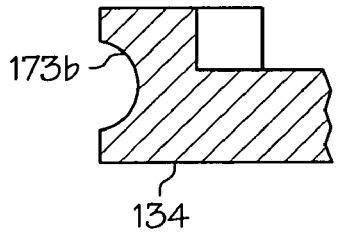
FIG. 6B is a sectional view of the front member taken along line 6B-6B of FIG. 6.

In addition, or alternatively, the front member 112 can be provided with one or more tongue and groove structures or other registration structures. As shown in FIG. 6, the illustrative example of the front member 112 comprises two tongue and groove structures 170 that are each defined by a registration pin 174*b* and two grooves 172*b*, 173*b* adapted to each simultaneously receive portions of the registration pin 174*b*. As shown in FIGS. 6, 6A and 6B, each tongue and groove structure 170 comprises a groove 172*b* defined in the first front member 124 and a groove 173*b* defined in the second front member 134. A registration pin 174*b* of each tongue and groove structure can be mounted with respect to one of the grooves 172*b*, 173*b*, for example, as described with respect to the registration pin 174*a* above. For instance, a screw 176*b* can be provided to extend through a counterbore in the registration pin 174*b* to mount the registration pin 174*b* with respect to the first front member 124. Once mounted, a portion of a corresponding registration pin 174*b* longitudinally extends within the corresponding groove 172*b* defined in the first front member 124. Another portion of each corresponding registration pin 174*b* extends out of the corresponding groove 172*b* to define the tongue portion of the tongue and groove structure 170. The tongue portion is configured to be received in a corresponding groove 173*b* defined in the second front member 134. Therefore, like the first and second rear members 122, 132, a predetermined orientation may be achieved between the first and second front members 124, 134 by way of one or more tongue and groove structures 170 and/or other registration structures. As shown, each tongue includes a cylinder of substantial semicircular cross section while the groove comprises a substantial semicircular groove configured to receive the tongue. In further examples, the tongue and groove may comprise other shapes such as rectangular, square, triangular or other cross sectional shapes.

The crimping apparatus 100 can be used with a wide range of crimping machines. For example, the crimping apparatus 100 can be used with a ProCrimp™ 1390 crimping machine available from Eaton Aeroquip Inc. of Maumee, Ohio. An Aeroquip ProCrimp™ 1390 crimping machine is illustrated somewhat schematically as reference number 500 in FIGS. 10-19. It is understood that other crimping machines may be used with one or more aspects of the present invention. Regardless of the crimping machine used, the crimping apparatus 100 can be configured to be removably positioned with respect to the crimping machine while the die members 140 remain movably attached to the support structure 110.

Figure 11:
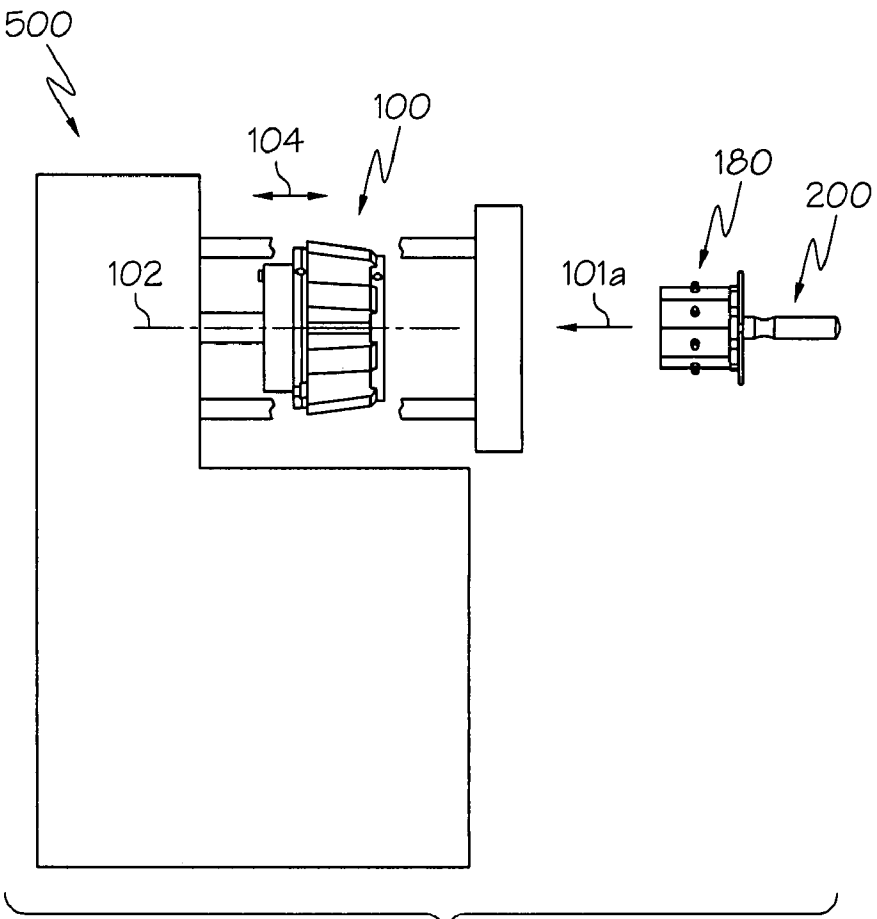
FIG. 11 depicts the crimping apparatus and crimping machine of FIG. 10 with the crimping apparatus being mounted to the crimping machine and the crimping member set and crimping tool of FIG. 7 being aligned with an axis of the crimping apparatus.
Figure 10:
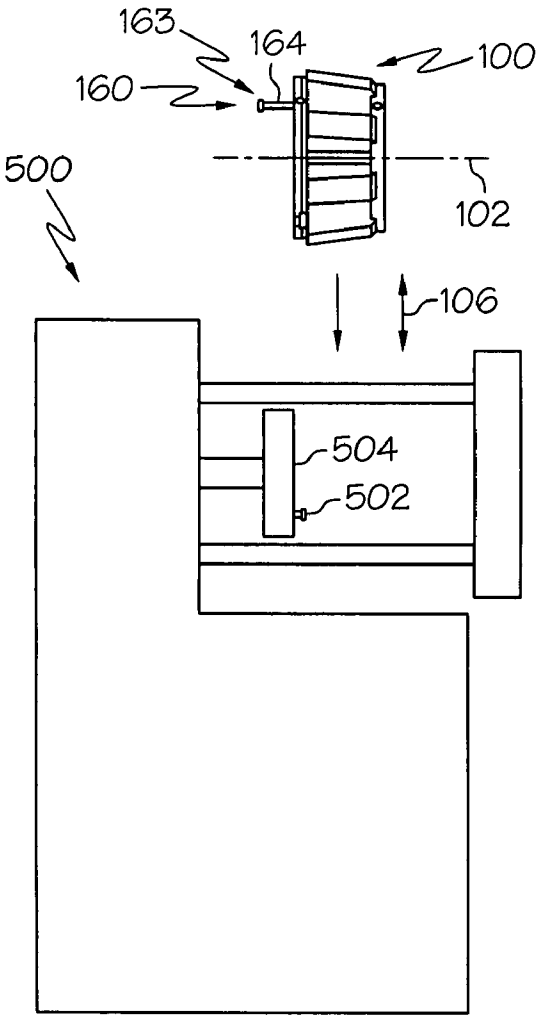
FIG. 10 depicts a schematic view of an example crimping machine and the example crimping apparatus of FIG. 1 prior to being mounted to the crimping machine.

As shown in the partial schematic views of FIGS. 10 and 11, the crimping apparatus 100 can include a connecting structure 160 configured to permit mounting of the crimping apparatus 100 to the crimping machine 500 to substantially inhibit a relative movement between the crimping apparatus 100 and a portion of the crimping machine 500 along a direction 104 that is substantially parallel to the axis 102 of the crimping apparatus 100. The connecting structure 160 can also be configured to permit dismounting of the crimping apparatus 100 from the crimping machine 500 by permitting a relative movement between the crimping apparatus 100 and the portion of the crimping machine 500 along a direction 106 that is substantially perpendicular to the axis 102 of the crimping apparatus 100. In addition, or alternatively, the connecting structure 160 may be configured to permit dismounting of the crimping apparatus 100 from the crimping machine 500 by permitting a relative movement between the crimping apparatus 100 and the portion of the crimping machine 500 along one or more other directions that are not substantially perpendicular to the axis of the crimping apparatus.

The connecting structure 160 can comprise a wide range of structures and can comprise a plurality of identical or different connecting members. In one example, a tool such as a wrench or screw driver can be used to tighten a connecting member to mount the crimping apparatus to the crimping machine. Once appropriately mounted with the tool, the connecting structure can substantially inhibit a relative movement between the crimping apparatus and a portion of the crimping machine along a direction that is substantially parallel to the axis of the crimping apparatus. Moreover, upon loosening and/or removal of the screws or bolts with the tool, the connecting structure can also be configured to permit dismounting of the crimping apparatus from the crimping machine by permitting a relative movement between the crimping apparatus and the portion of the crimping machine along a direction that is substantially perpendicular to the axis of the crimping apparatus.

In further examples, the connecting structure can be designed to permit tooless removable mounting between the crimping apparatus and the crimping machine. For example, tooless removable mounting can include mounting the crimping apparatus to the crimping machine without the use of tools. Tooless removable mounting can also include dismounting the crimping apparatus from the crimping machine without the use of tools. In further examples, tooless removable mounting can include mounting and dismounting between the crimping apparatus and the crimping machine without the use of tools. Providing a tooless connecting structure can be beneficial to permit mounting and/or dismounting between the crimping apparatus and the crimping machine with reduced time and effort. Various connecting structures may be provided to permit tooless removable mounting between the crimping apparatus and the crimping machine.

For example, a latching or interlocking arrangement may be provided. In one example a tongue and groove structure may be provided. One example of the tongue and groove structure can comprise a dovetail structure although other tongue and groove structures may be provided.

As shown in FIGS. 10 and 11, the connecting structure 160 provides tooless removable mounting between the crimping apparatus 100 and the crimping machine 500. Referring to FIGS.,1 and 2, the connecting structure 160 can comprise a first connecting device 161 and/or a second connecting device 163. The first connecting device 161 can comprise a groove structure although the first connecting device may be provided, additionally or alternatively, with a tongue structure. As shown, the groove structure comprises a pair of slots 162*a*, 162*b* although one or more than two slots may be provided in further examples. The slots 162*a*, 162*b*, are configured to receive a corresponding shank of a screw 502 (see FIG. 10) attached to a press plate 504 of the crimping machine 500. The second connecting device 163 comprises a tongue of a tongue and groove structure although the second connecting device may be provided, additionally or alternatively, with a groove structure. In the illustrated example, the tongue comprises a screw 164 attached to the rear member 114 and configured to be received in a corresponding slot (not shown) of the press plate 504.

Figure 16:
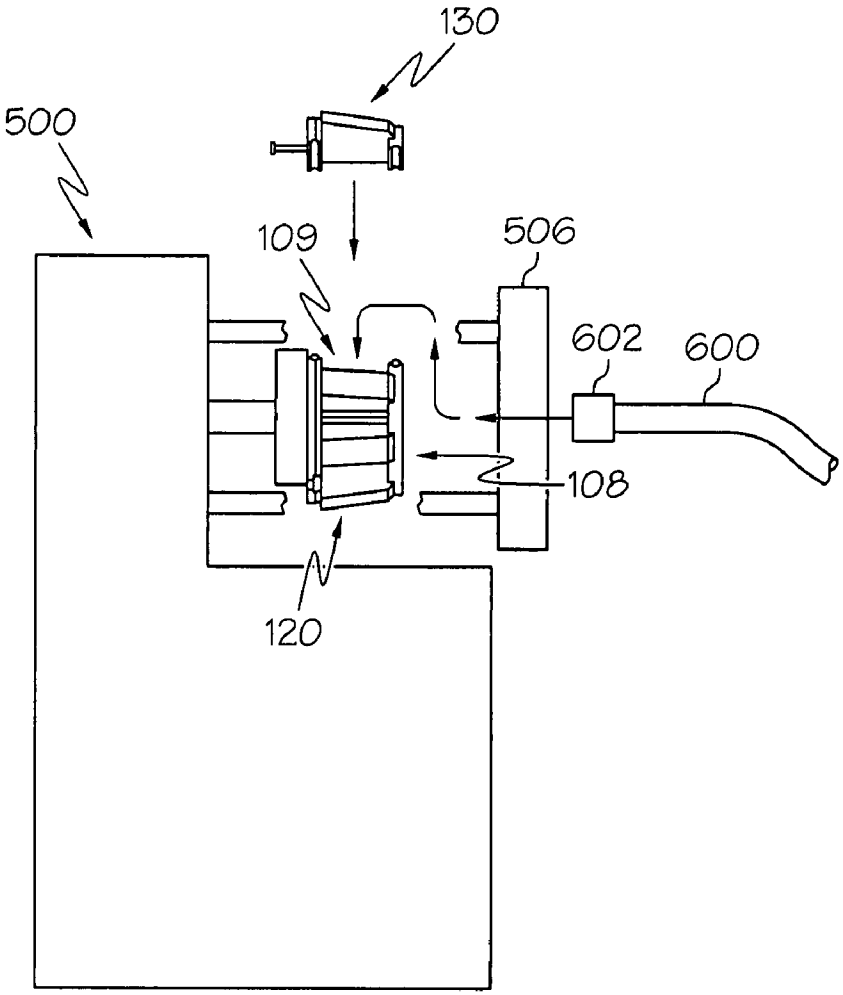
FIG. 16 depicts a second element and an end of a first element being inserted through an alternative passage into the interior area of the crimping apparatus, and thereafter moving the second portion to engage the first portion of the support structure.
Figure 15:
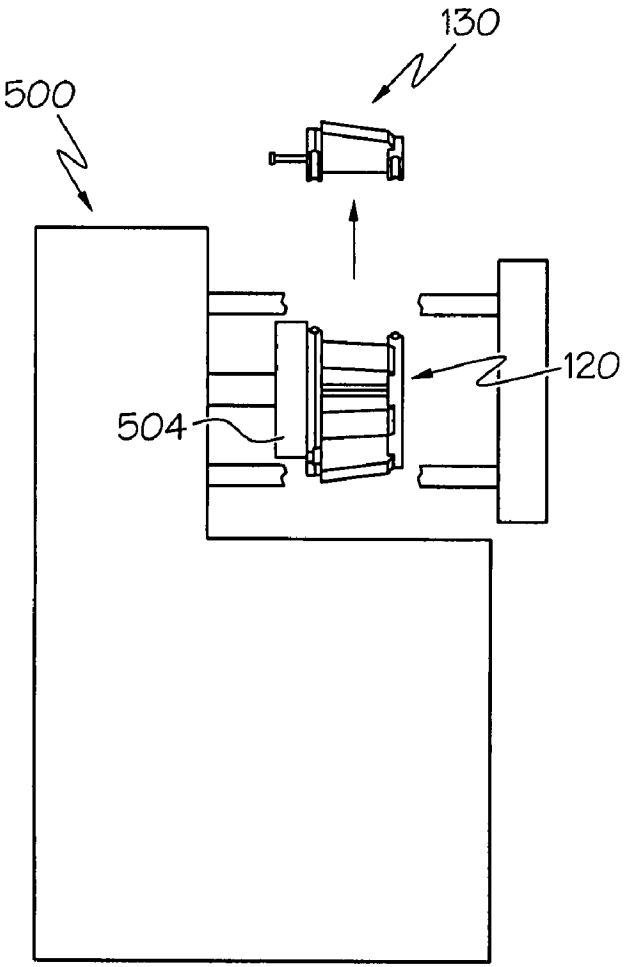
FIG. 15 depicts the crimping apparatus of FIG. 14B moved further away from the cam ring of the crimping machine and having a second portion of a support structure being moved completely out of engagement with a first portion of the support structure.

It is also contemplated that each portion of the support structure 110 may be provided with at least one connecting member to facilitate axial alignment between the portions and concurrent movement between the press plate and the portions of the support structure. For example, as shown, the first portion 120 of the support structure 110 is provided with the first connecting member 161 while the second portion 130 of the support structure 110 is provided with the second connecting member 163. The connecting members 161, 163 are configured to mount the crimping apparatus 100 to the crimping machine 500 such that the first and second portions 120, 130 of the support structure 110 are axially aligned with respect to one another. Moreover, the connecting members 161, 163 permit concurrent movement between the press plate 504 and first and second portions 120, 130 of the support structure 110. Providing each portion 120, 130 of the support structure 110 with a connecting member also permits removal of one or more of the portions from the crimping machine while the remaining portions of the support structure remain connected to the crimping machine. For example, as shown in FIGS. 15 and 16, the first portion 120 remains connected to the press plate 504 while removing the second portion 130 from the first portion 120.

It is also contemplated that at least one portion of the support structure 110 may be provided without a connecting member configured to directly connect to the crimping machine while at least one other portion of the support structure includes a connecting member configured to directly connect to the crimping machine. For example, the first portion 120 may be provided with a connecting member to connect to the crimping machine while the second portion 130 does not include a connecting member to connect directly to the crimping machine. In such embodiments, the first and second portions 120, 130 may be configured to attach to one another such that the second portion 130 is indirectly attached to the crimping machine by way of the first portion 120. For example, the first portion 120 may include a connecting member to directly attach the first portion 120 to the crimping machine. A latching structure, fastening arrangement, or other attaching structure may be used to attach the second portion 130 to the first portion 120. The attachment between the first and second portions 120, 130 can facilitate axial alignment between the portions. Moreover, the connection between the first portion 120 and the press plate 504 and the connection between the first and second portions 120, 130 can facilitate concurrent movement between the press plate 504 and the portions of the support structure 110.

Figure 3C:
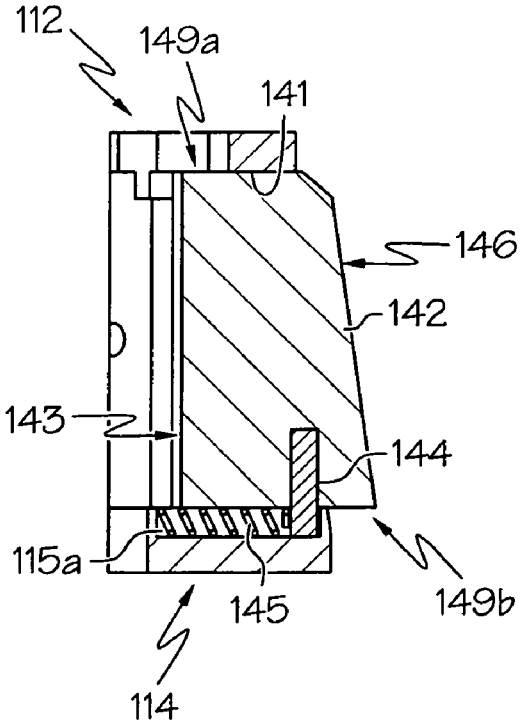
FIG. 3C is a sectional view of the crimping apparatus taken along line 3C-3C of FIG. 3.

The support structure 110 can comprise a wide variety of configurations to permit movable attachment of a plurality of die members 140 to the support structure 110. For instance, the front member 112 and/or the rear member 114 can be configured to permit movable attachment of the die members 140. As shown in FIGS. 1 and 6, the front member 112 can comprise a plurality of guide channels 141 radially arranged about the axis 102 of the crimping apparatus 100. As shown in FIGS. 1 and 3C, each of the guide channels 141 is adapted to slidingly receive a first end portion 149*a* of a corresponding die member 140 to allow each die member 140 to move with respect to the support structure 110 in a direction toward and away from the axis 102 of the crimping apparatus 100. As shown in FIGS. 3C and 5, the rear member 114 can comprise a pair of guide channels 115*a*, 115*b* associated with each die member 140 that are each configured to receive an end of a corresponding guide pin 144 to define the maximum and minimum movements of the die members 140. Although a pair of guide channels 115*a*, 115*b* are illustrated, it is understood that a single or more than two guide channels may be associated with each die member 140. Each of the guide channels 115*a*, 115*b* are configured to receive an end of a guide pin 144 extending from a second end portion 149*b* of a corresponding die member 140 to limit movement of the die members 140. As further illustrated in FIG. 3C, one or all of the guide channels 115*a*, 115*b* associated with each die member 140 may include a biasing member, such as a compression spring 145. The compression spring 145 can be positioned in the guide channels to act against the guide pins 144 to bias each die member 140 away from the axis 102, thereby maximizing the interior area 103 of the crimping apparatus 100. Each of the guide channels 115*a*, 115*b* may be provided with a similar compression spring 145 to increase the force exerted on the die members 140. As shown in FIG. 3C, each die member 140 further includes one side comprising a cam surface 146 that flares outwardly from the axis 102 in a direction from the first end portion 149*a* to the second end portion 149*b* of the die member 140.

The die members 140 can include various structures and sizes for performing a crimping action with the crimping machine 500. Each die member 140 can comprise a crimping member 182 and/or a retainer 142. For example, each die member 140 can comprise a crimping member without a retainer. In such an embodiment, the crimping apparatus 100 is formed with a predetermined single crimping arrangement for performing the crimping function. A separate crimping apparatus can be purchased for each contemplated crimping arrangement.

Alternatively, as shown, each die member 140 can comprise a retainer 142 configured to removably connect a separate crimping member 182 to the retainer 142. Thus, the crimping apparatus 100 including retainers 142 can be sold separately from the crimping members 182. The crimping apparatus 100 can therefore act as a master assembly that can receive different sets of crimping members to provide a wide variety of alternative crimping arrangements. Only one master assembly needs to be purchased and one or more less expensive crimping sets may be purchased to provide alternative crimping arrangements for effectively crimping elements having different sizes and/or shapes.

Figure 3D:
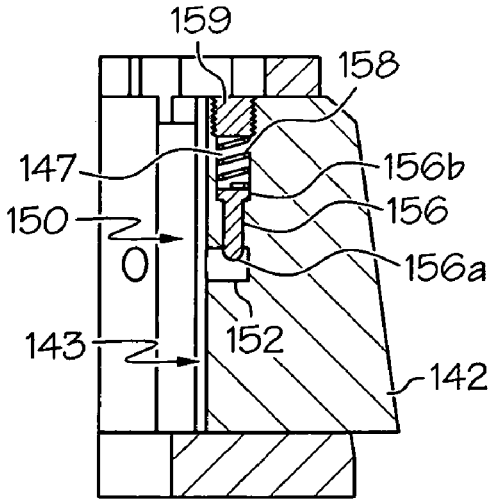
FIG. 3D is a sectional view of the crimping apparatus taken along line 3D-3D of FIG. 3.
Figure 8:
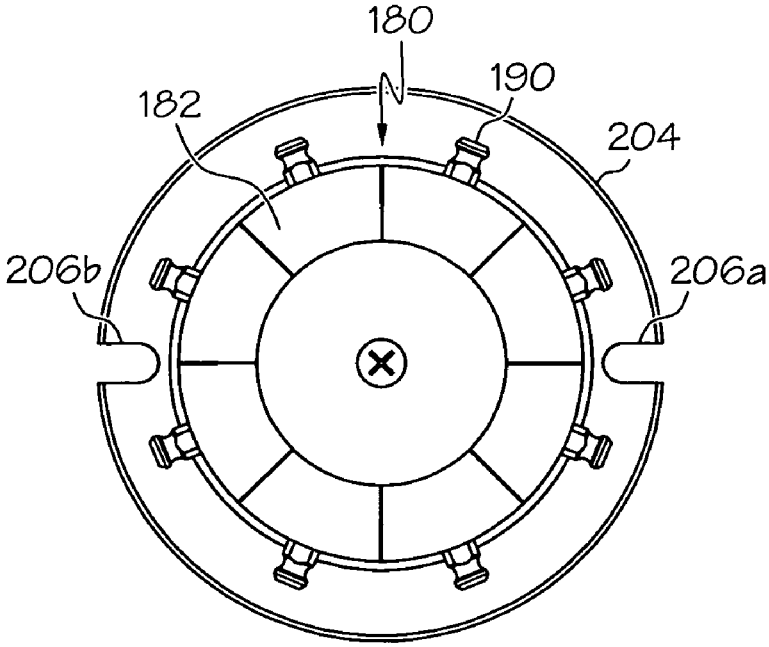
FIG. 8 is a rear view of the crimping member set and carrying tool of FIG. 7.
Figure 9:
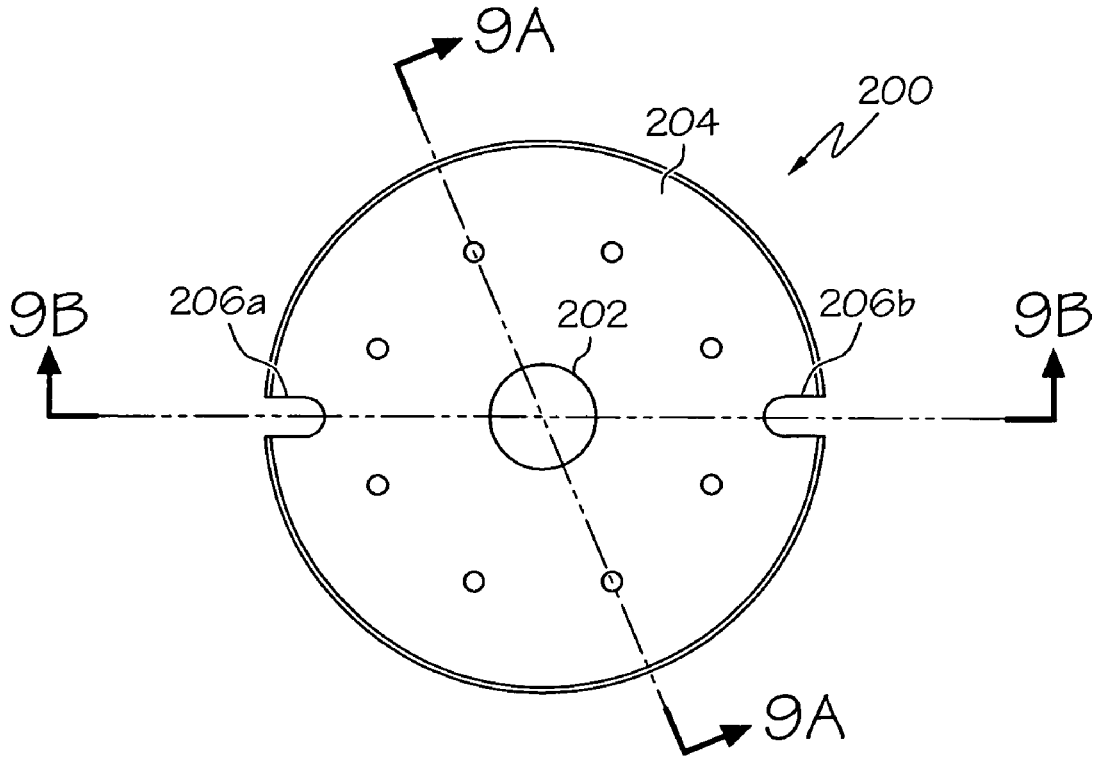
FIG. 9 is a front view of the crimping member set and carrying tool of FIG. 7.
Figure 12A:
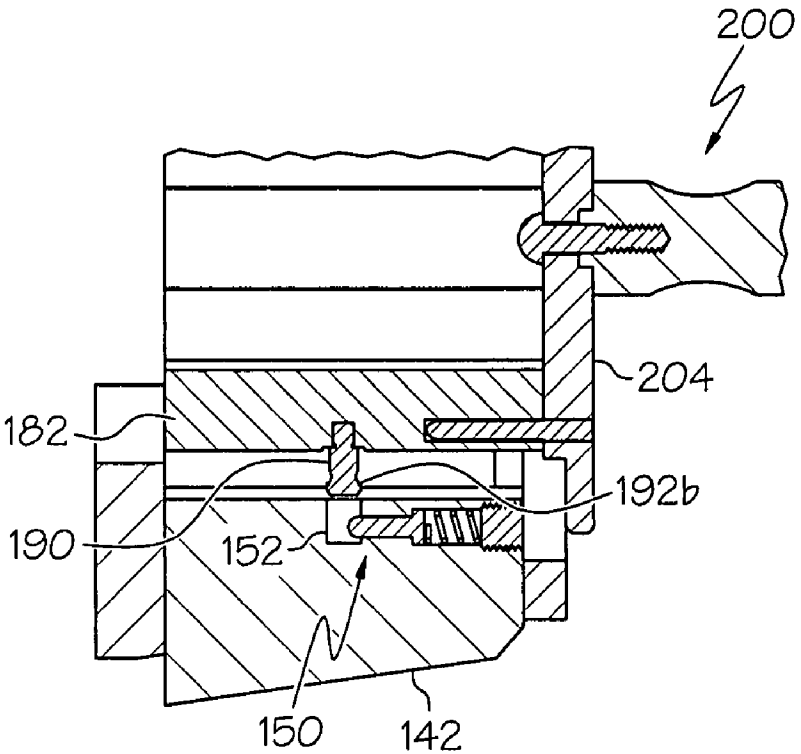
FIG. 12A depicts a partial sectional view of FIG. 12 illustrating a protrusion of a crimping member being aligned with an aperture of an engagement structure of a retainer.

Each retainer 142, if provided, can further comprise an engagement structure 150 configured to removably connect a crimping member 182 to the retainer 142. Various engagement structures may be used in accordance with aspects of the present invention. For example, a dovetail joint, tongue and groove structure, or other connecting structure may be used. In accordance with one example, the engagement structure can include an aperture and/or a latch. In one example, the engagement structure illustrated and described with respect to FIGS. 8-10 of U.S. Pat. No. 6,257,042, which is herein incorporated by reference, may be used in accordance with aspects of the present invention. As shown in FIGS. 3D and 12A, the engagement structure 150 can include an aperture 152 extending through a press surface 143 of the retainer 142. The aperture 152 is configured to selectively receive a protrusion 190 from a corresponding crimping member 182. As further shown, the engagement structure 150 can also include a latch configured to engage the protrusion 190 of the crimping member 182 to removably connect the crimping member 182 to the retainer 142. Although a wide variety of latches may be used, the illustrated latch comprises a pin 156 with a rounded end portion 156*a* that is biased to extend into the aperture 152. The pin 156 can include a shoulder 156*b* configured to act as a stop to limit the extent that the end portion 156*a* may move into the aperture 152. A biasing member, such as the illustrated compression spring 158, is configured to extend within a bore 147 in the retainer 142. An end cap 159 is threaded into an end of the bore 147 to retain the spring 158 and the pin 156 and to provide a precompression to the spring 158 to bias the end portion 156*a* into the aperture 152.

Figure 7:
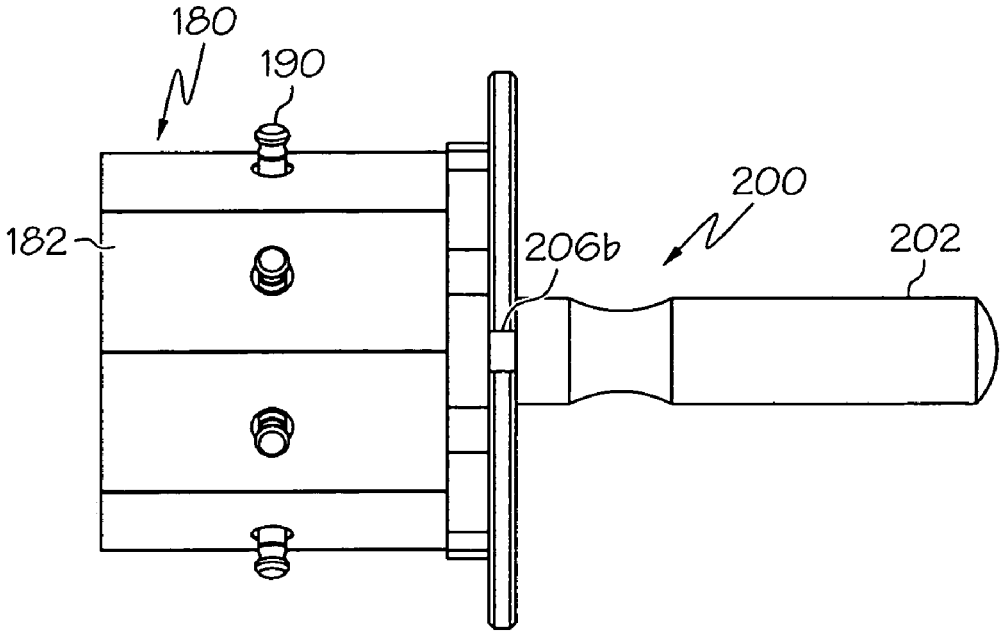
FIG. 7 is a side elevational view of one example of a crimping member set being carried by one example of a carrying tool in accordance with aspects of the present invention.

If provided with retainers, a plurality of crimping members may also be provided for attaching to the retainers. For example, a protrusion 190 from each crimping member 182 may be extended within the aperture 152 to be engaged by the latch for removably connecting the crimping member 182 to the corresponding retainer 142. Each crimping member 182 may be separately connected to each corresponding retainer 142. Alternatively, a plurality of crimping members 182 may be simultaneously connected to each corresponding retainer 142. For example, in accordance with one example, each crimping member 182 of a crimping member set 180 may be simultaneously attached to a corresponding. one of each of the retainers 142. FIG. 7 illustrates a crimping member set 180 being supported by an optional tool 200.

Figure 9A:
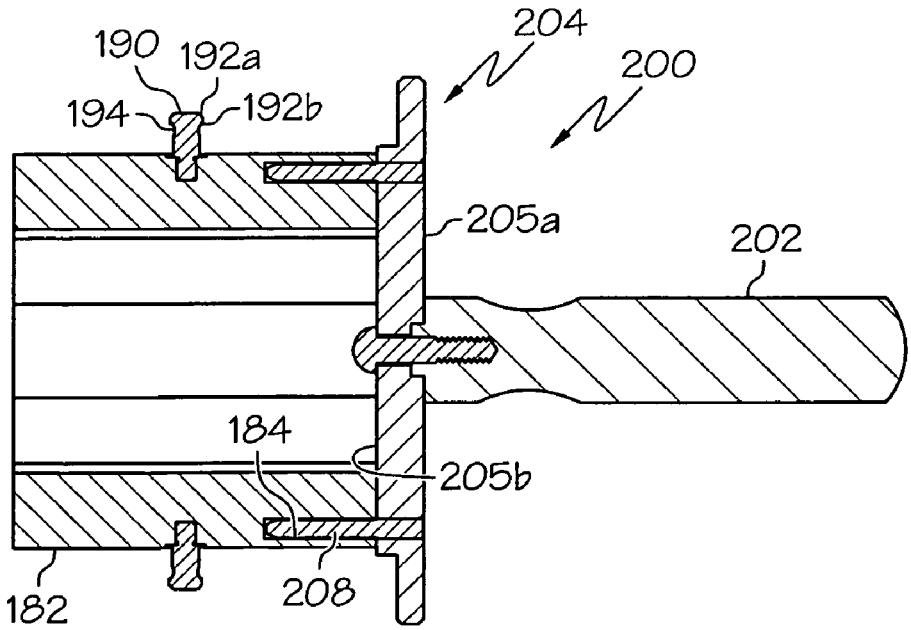
FIG. 9A is a sectional view of the crimping member set and carrying tool taken along line 9A-9A of FIG. 9.
Figure 9B:
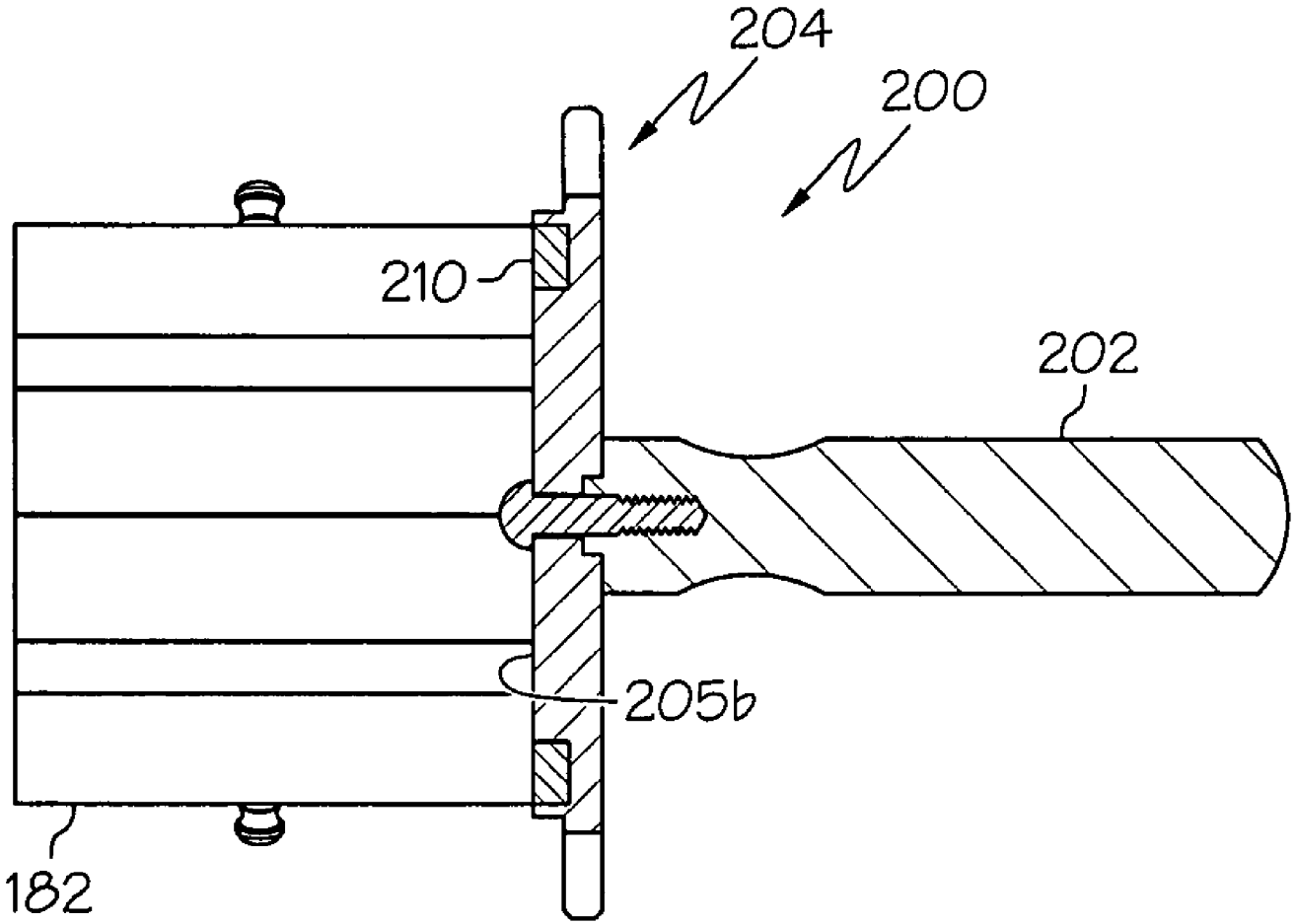
FIG. 9B is a sectional view of the crimping member set and carrying tool taken along line 9B-9B of FIG. 9.

The tool 200 may be provided to support the crimping members 182 for simultaneous attachment to the corresponding retainers 142. As shown in FIGS. 7, 8, 9, 9A and 9B, the tool 200 includes a handle 202 attached to a first side 205*a* of an alignment plate 204. A plurality of carrying pins 208 can be attached to the alignment plate 204 to extend from the second side 205*b* of the alignment plate 204. As shown in FIG. 9A, each carrying pin 208 is configured to be received in a corresponding carrying bore 184 axially defined in an end of each crimping member 182. As shown in FIG. 9B, the alignment plate 204 may include one or more magnets 210 configured to attract the crimping members 182 toward the second side 205*b* of the alignment plate 204 while the carrying pins 208 of the tool 200 are inserted in the carrying bores 184 of the crimping members. The alignment plate 204 can also include slots 206*a*, 206*b* configured to provide appropriate alignment between the crimping member set 180 and the retainers 142. Each slot 206*a*, 206*b* is configured to receive a respective alignment protrusion 113*a*, 113*b*, such as the head of a screw, extending from the front face of the front member 112 to provide rotational alignment between the crimping member set 180 and the retainers 142.

Methods of crimping with the example crimping machine 500 and the example crimping apparatus 100 including a support structure 110 having a first and second portions 120, 130 will now be described with reference to FIGS. 10-19. Portions of the crimping machine 500 and/or the crimping apparatus 100 may be shown in somewhat schematic form in FIGS. 10-19. Although not required in all embodiments, the connecting structure 160 of the crimping apparatus 100 can be designed to permit tooless removable mounting between the crimping apparatus 100 and the crimping machine 500. For example, as shown in FIGS. 10 and 11, the crimping apparatus 100 can be mounted on the crimping machine 500 or dismounted from the crimping machine 500 by moving the crimping apparatus 100 along a direction 106 that is substantially perpendicular to the axis 102 of the crimping apparatus 100. By way of a mounting movement, the slots 162*a*, 162*b* of the first portion 120 respectively receive the corresponding screws 502 extending from the press plate 504 of the crimping machine 500. In addition, the screw 164 of the second portion 130 is received by a corresponding slot (not shown) in the press plate 504. Once mounted, as shown in FIG. 11, the connecting structure 160 substantially inhibits a relative movement between the crimping apparatus 100 and the press plate 504 of the crimping machine 500 along the direction 104 that is substantially parallel to the axis 102 of the crimping apparatus 100.

Example methods of the present invention can include the step of selecting a crimping member set 180 from a plurality of alternative crimping member sets. The crimping member 180 set can be selected to accommodate a particular crimping arrangement. Once selected, the tool 200 is engaged with the crimping member set 180 to carry the crimping members 182 and help install the crimping members to the retainers 142. For example, as further shown in FIG. 11, the crimping member set 180 and crimping tool 200 of FIG. 7 can be aligned with the axis 102 of the crimping apparatus 100. The crimping member set 180 can then be inserted in direction 101*a* along the axis 102 until the crimping member set 180 is received within the interior area 103 of the crimping apparatus 100.

Figure 12:
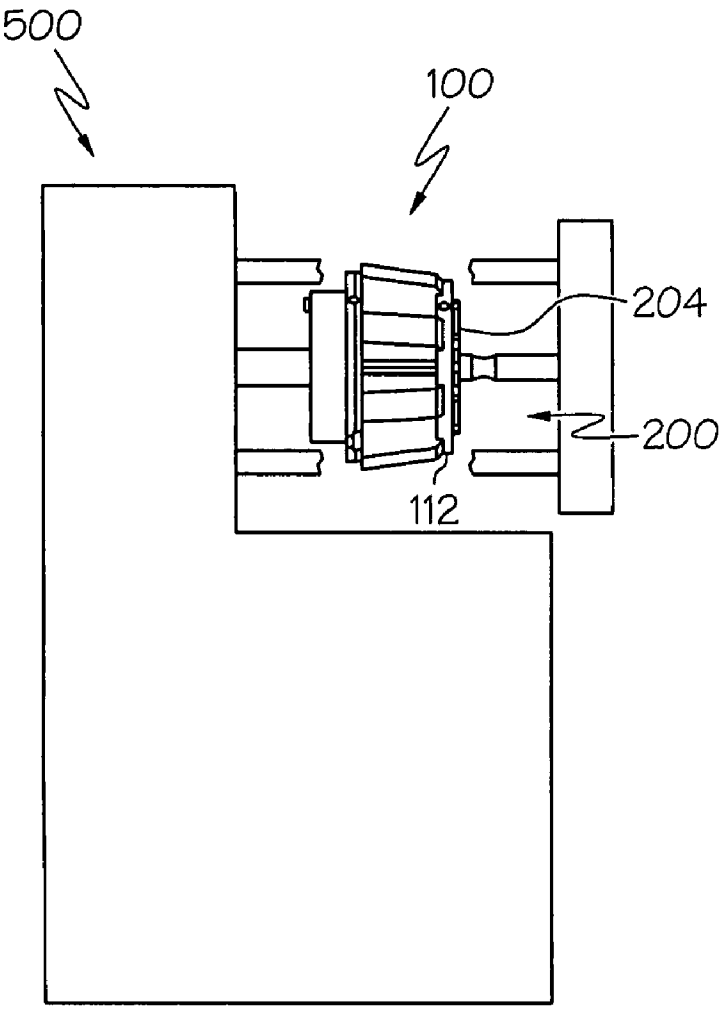
FIG. 12 depicts the crimping member set being inserted into an interior area of the crimping apparatus.

As shown in FIG. 12, once appropriately inserted, the alignment plate 204 of the tool 200 abuts the front surface of the front member 112 to provide appropriate axial alignment between the crimping member set 180 and the retainers 142 of the crimping apparatus 100. Moreover, alignment protrusions 113*a*, 113*b* extending from the front surface of the front member 112 can be received in the corresponding slots 206*a*, 206*b* of the alignment plate 204 to provide appropriate rotational alignment between the crimping member set 180 and the retainers 142. As shown in FIG. 12A, once the crimping member set 180 is rotationally and axially aligned with respect to the retainers 142, the protrusion 190 of each crimping member 182 is aligned with the corresponding aperture 152 of the engagement structure 150 of each retainer 142.

Figure 13A:
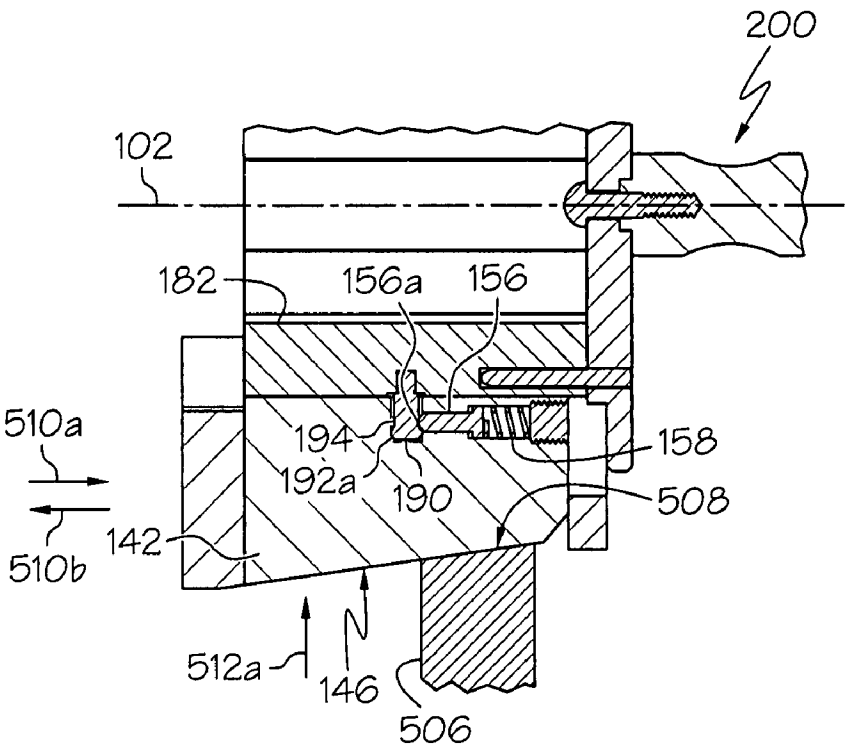
FIG. 13A depicts a partial sectional view of FIG. 13 illustrating the protrusion of the crimping member being received within the aperture and engaging a latch of the engagement structure.
Figure 13:
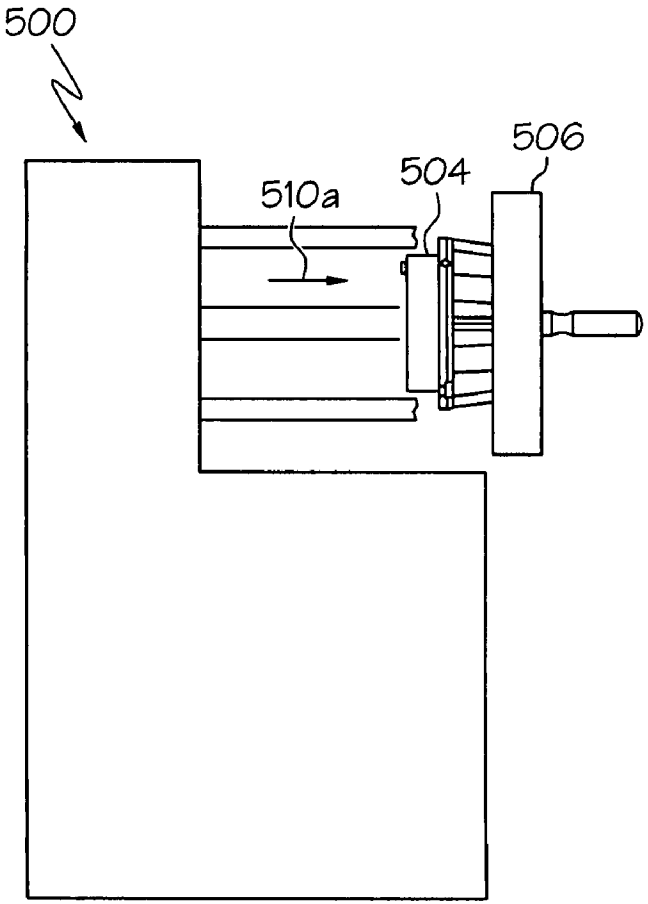
FIG. 13 depicts the retainers being pressed against a cam ring of the crimping machine to move the retainers toward the axis of the crimping apparatus.

After achieving axial and rotational alignment between the crimping member set 180 and the retainers 142, the crimping machine 500 is activated to push the retainers 142 in direction 510*a* against the cam ring 506 as shown in FIG. 13. As shown in FIG. 13A, a movement in direction 510*a* causes the cam surface 146 of each retainer 142 to slide against an inner surface 508 of the cam ring 506. Movement in the direction 510*a* therefore causes each retainer 142 to move in direction 512*a* toward the axis 102 of the crimping apparatus 100 against the bias of compression springs 145. After sufficient movement of each retainer 142 in direction 512*a*, the rounded end portion 156*a* of each pin 156 engages a beveled cam surface 192*a* of each protrusion 190. Further movement in direction 512*a*, presses the beveled cam surface 192*a* against the rounded end portion 156*a* of the pin 156 to cause portions of the pin 156 to move out of the aperture 152 against the bias of the spring 158. The rounded end portion 156*a* eventually biases back in the opposite direction to be received in the groove 194 of the protrusion 190. Once the end portion 156*a* is received in the groove 194 6*f* the protrusion 190, the crimping member 182 is removably connected to the corresponding retainer 142 by the engagement structure 150 of the corresponding retainer 142.

It will be appreciated that the machine can be used to move the tool and the crimping member set in the opposite direction 510*b* can cause the crimping members 182 to disconnect from the retainers 142. Indeed, movement in the opposite direction 510*b* moves the retainers 142 out of engagement with the cam ring 506 of the crimping machine 500. Therefore, the compression springs 145 again bias the retainers 142 to extend outwardly away from the axis 102 of the crimping apparatus 100. As the tool 200 still engages the crimping members 182, the springs 145 cause another beveled cam surface 192*b* (see FIG. 12A) of each protrusion 190 to act against the rounded end 156*a* of each pin 156 to disengage each of the protrusions 190 from the corresponding latch of each retainer 142.

Figure 14A:
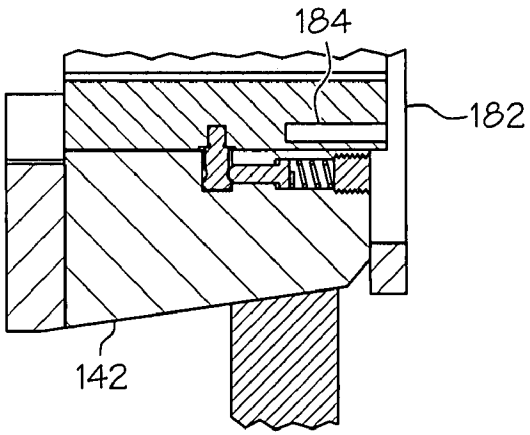
FIG. 14A depicts a partial sectional view of the crimping apparatus illustrated in FIG. 14.
Figure 14B:
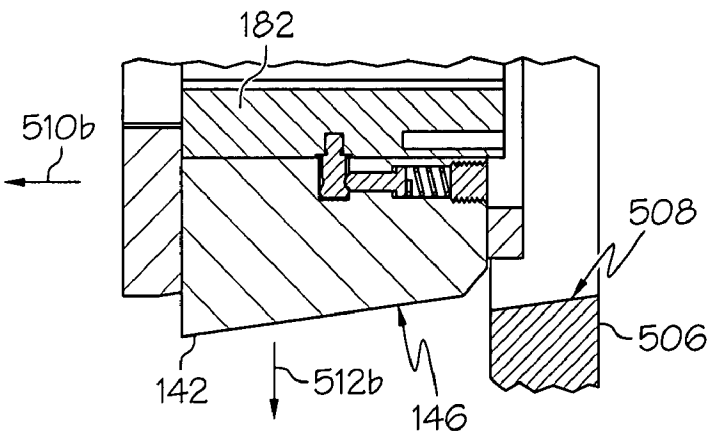
FIG. 14B depicts a partial sectional view of the crimping apparatus moved away from the cam ring such that the retainers, together with the crimping members move radially away from the axis of the crimping apparatus.
Figure 14:
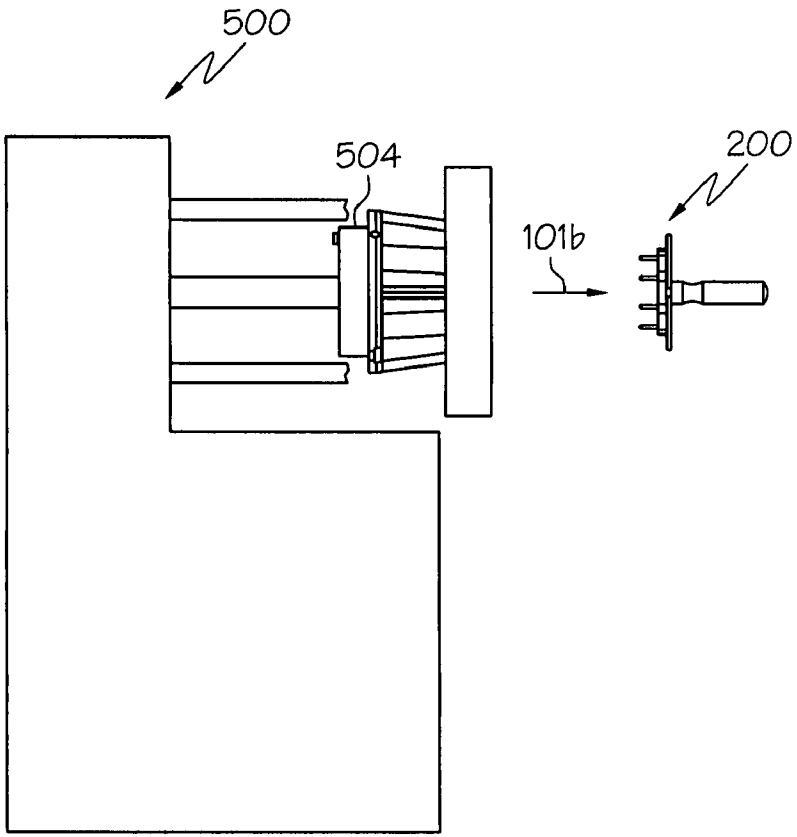
FIG. 14 depicts the tool of FIG. 13 being removed from the crimping member set.

Alternatively, the crimping members 182 can be left connected to the retainers 142. Indeed, as shown in FIGS. 14 and 14A, once the crimping members 182 are connected to the retainers 142, the tool 200 can be moved along direction 101*b* to disengage the carrying pins 208 of the tool 200 from the carrying bores 184 of each crimping member 182. As shown in FIGS. 14 and 14A, the tool 200 can be removed from the crimping member set 180 while each crimping member 182 remains connected to a corresponding one of the retainers 142. Next, as shown in FIG. 14B, the crimping machine 500 can be activated to move the press plate 504 along direction 510*b*. As the cam surface 146 of each retainer 142 is moved out of engagement with the inner surface 508 of the cam ring 506, the compression spring 145 (see FIG. 3C) causes the retainers 142 and connecting crimping members 182 to move in direction 512*b* to a retracted position. The crimping apparatus 100 is then configured to receive first and second element 600, 602 to be crimped by the predetermined crimping arrangement associated with the chosen crimping member set 180.

Figure 17:
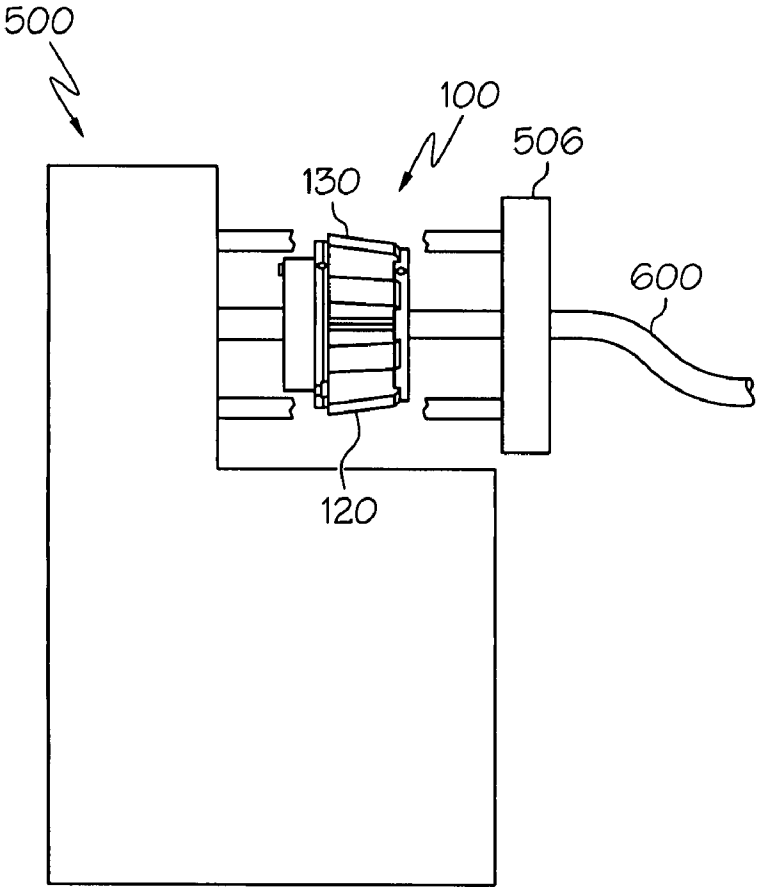
FIG. 17 depicts the second element and the end of the first element being inserted in the interior area with the second portion engaged with the first portion of the support structure just prior to crimping the second element to the first element.

As shown in FIG. 16, a second element 602 can be inserted over an end of the first element 600. Next, if size permits, the second element 602 and the end of the first element 600 can be inserted through the interior area of the cam ring 506 and, referring to FIG. 3, through the axial passage 108 and into the interior area 103 of the crimping apparatus 100. In further examples, an oversized second element and end of the first element can be inserted though an alternative passage 109. For example, as shown in FIGS. 4 and 15, the second portion 130 can be moved out of engagement with the first portion 120 of the support structure 110. As shown in FIG. 16, the second element 602 and the end of the first element 600 can then be inserted through the interior area of the cam ring 506 and then through the alternative passage 109 of the crimping apparatus 100. Next, the second portion 130 is again reengaged with the first portion 120 to close the alternative passage 109 as shown in FIG. 17.

Figure 18:
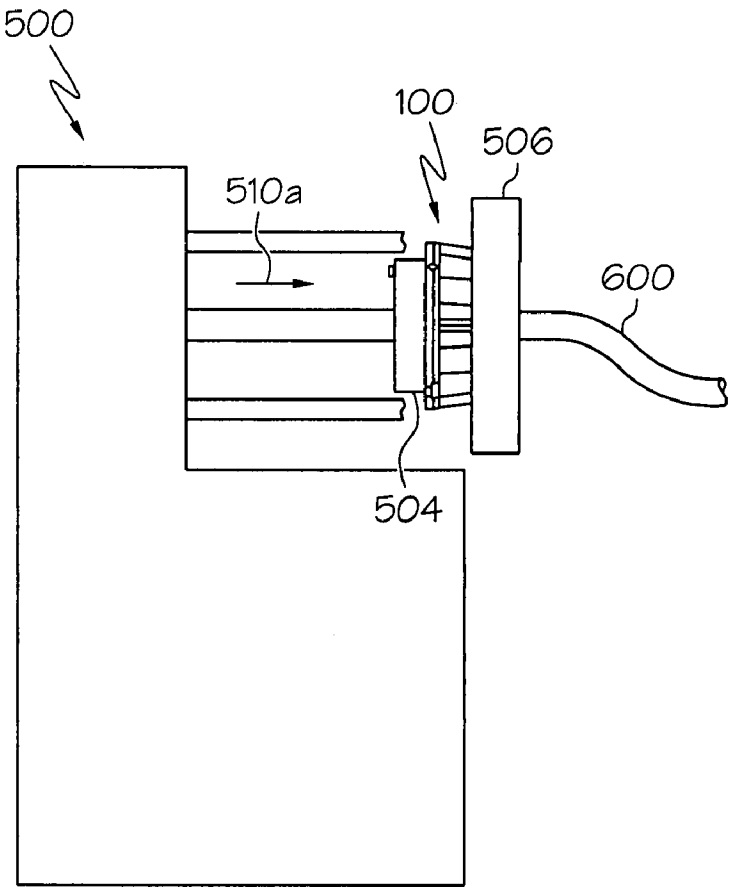
FIG. 18 depicts the retainers being pressed against the cam ring of the crimping machine to move the retainers and crimping members toward the axis of the crimping apparatus and thereby crimp the second element to the end of the first element.
Figure 19:
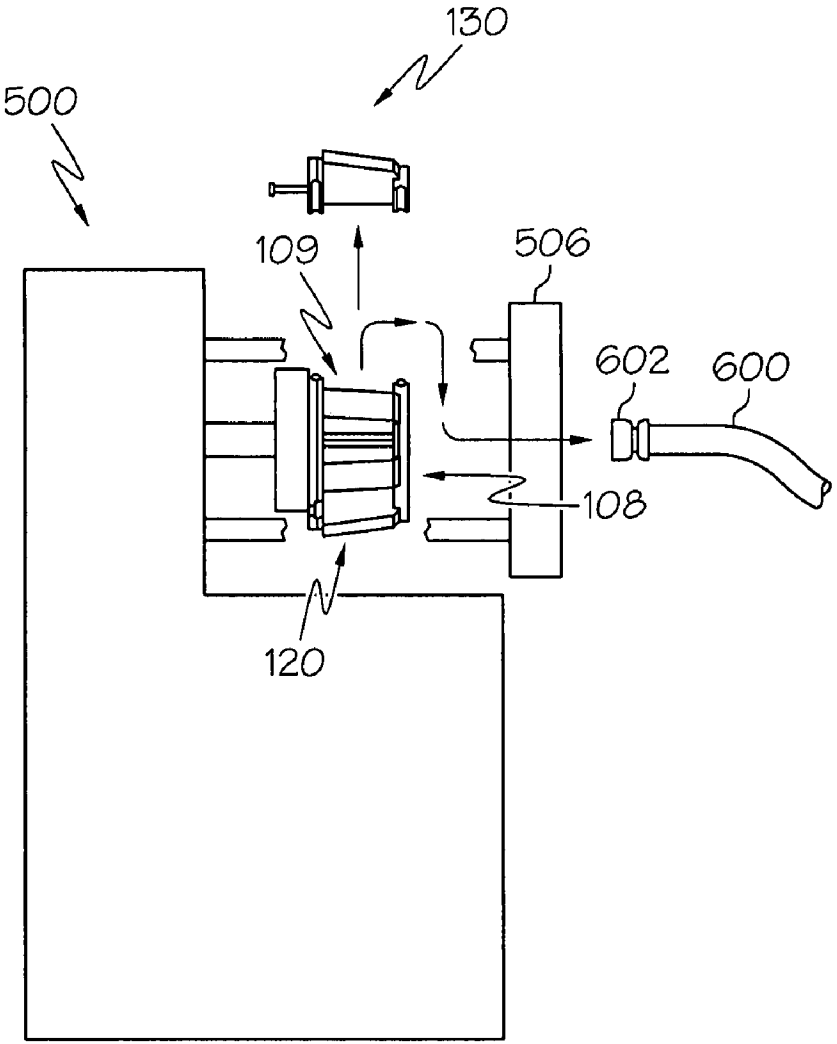
FIG. 19 depicts the second portion being moved completely out of engagement with the first portion and removing the second crimped element out of the interior area of the crimping apparatus by way of the alternative passage.

After appropriate positioning of the second element 602 and the end of the first element 600 into the interior area 103 of the crimping apparatus 100, the crimping machine 500 is again activated to push the retainers 142 and connected crimping members 182 in direction 510*a* against the cam ring 506 as shown in FIG. 18. Once sufficiently pushed in direction 510*a*, the crimping members 182 crimp the second element 602 to the first element 600. After crimping, the crimping machine 500 can be activated to move the crimping apparatus out of engagement with the cam ring 506 as shown in FIG. 19. The second element 602 and the end of the first element 600 can then be removed by way of the axial passage 108 (see FIG. 3) and/or the alternative passage 109 (see FIG. 4).

Methods of crimping with the example crimping machine 500 can also be performed with a crimping apparatus wherein each die member 140 comprises a crimping member without a retainer. In such an embodiment, the crimping apparatus is formed with a predetermined single crimping arrangement for performing the crimping function. To perform the crimping method, the crimping apparatus may be mounted as discussed with respect to FIG. 13 above. Next, as shown in FIG. 16 a second element 602 can be inserted over the end of the first element 600 as previously described. Next, if size permits, the second element 602 and the end of the first element 600 can be inserted through the interior area of the cam ring 506 and through the axial passage 108 and into the interior area 103 of the crimping apparatus 100. In further examples, an oversized second element and end of the first element can be inserted though an alternative passage 109. For example, as shown in FIG. 15, the second portion 130 can be moved out of engagement with the first portion 120 of the support structure 110. As shown in FIG. 16, the second element 602 and the end of the first element 600 can then be inserted through the interior area of the cam ring 506 and then through the alternative passage 109 of the crimping apparatus 100. Next, the second portion 130 is again reengaged with the first portion 120 to close the alternative passage 109 as shown in FIG. 17. After appropriate positioning of the second element 602 and the end of the first element 600 into the interior area 103 of the crimping apparatus 100, the crimping machine 500 is again activated to push the crimping members in direction 510*a*. The flared outer surfaces of the crimping members then engage the inner surface 508 of the the cam ring 506 as shown in FIG. 18. Once sufficiently pushed in direction 510*a*, the inner crimping surfaces of the crimping members crimp the second element 602 to the first element 600. After crimping, the crimping machine 500 can be activated to move the crimping apparatus out of engagement with the cam ring 506 as shown in FIG. 19. The second element 602 and the end of the first element 600 can then be removed by way of the axial passage 108 and/or the alternative passage 109.

The concepts of the present invention may be used with different types of crimping machines. For example, as described above, crimping machines may be employed with a press plate configured to move the crimping apparatus to engage a stationary cam ring. In another example, a crimping machine may be used wherein the crimping apparatus remains stationary and the cam ring is moved to engage the stationary crimping apparatus to perform the crimping procedure. In another example, crimping machines may be designed to simultaneously move the crimping apparatus and the cam ring to perform the crimping function.

From the above description of the invention, those skilled in the art will perceive improvements, changes and modifications. Such improvements, changes and modifications within the skill of the art are intended to be covered by the appended claims.

What is claimed:

1. A crimping apparatus for use with a crimping machine, the crimping apparatus comprising:

a support structure including a first portion and a second portion, wherein the second portion is assembled with the first portion such that the second portion is not hingedly connected to the first portion and the second portion engages the first portion to define an axial passage into an interior area of the crimping apparatus and wherein the second portion is configured to be disassembled from the first portion such that the second portion is moved completely out of engagement with the first portion to selectively define an alternative passage into the interior area of the crimping apparatus;

a registration structure configured to facilitate a predetermined orientation between the first and second portions of the support structure, wherein the registration structure comprises a groove and a tongue configured to be at least partially received by the groove; and a plurality of die members movably attached to the support structure and radially arranged about an axis of the crimping apparatus.

2. The crimping apparatus of claim 1, wherein each die member comprises a crimping member.

3. The crimping apparatus of claim 1, wherein each die member comprises a retainer including an engagement structure configured to removably connect a crimping member to the retainer.

4. The crimping apparatus of claim 3, wherein each die member further comprises a crimping member configured to be removably connected to the retainer of the corresponding die member by the engagement structure of the corresponding retainer.

5. The crimping apparatus of claim 1, wherein the crimping apparatus is configured to be removably positioned with respect to a crimping machine while the die members remain movably attached to the support structure.

6. The crimping apparatus of claim 1, wherein the plurality of die members include at least a first die member movably attached to the first portion of the support structure and at least a second die member movably attached to the second portion of the support structure.

7. The crimping apparatus of claim 1, further comprising a connecting structure configured to permit mounting of the crimping apparatus to a crimping machine to substantially inhibit a relative movement between the crimping apparatus and a portion of a crimping machine along a direction that is substantially parallel to an axis of the crimping apparatus.

8. The crimping apparatus of claim 7, wherein the connecting structure is further configured to permit dismounting of the crimping apparatus from a crimping machine by permitting a relative movement between the crimping apparatus and a portion of a crimping machine along a direction that is substantially perpendicular to the axis of the crimping apparatus.

9. The crimping apparatus of claim 7, wherein the connecting structure comprises a first connecting member and a second connecting member, wherein the first portion of the support structure is provided with the first connecting member and the second portion of the support structure is provided with the second connecting member.

10. A crimping apparatus for use with a crimping machine, the crimping apparatus comprising:

a support structure including a first portion comprising a first rear member attached to a first front member, and a second portion comprising a second rear member attached to a second front member, wherein the second portion is assembled with the first portion such that the second portion is not hingedly connected to the first portion and the second portion engages the first portion to define an axial passage into an interior area of the crimping apparatus and wherein the second portion is configured to be disassembled from the first portion such that the second portion is moved completely out of engagement with the first portion to selectively define an alternative passage into the interior area of the crimping apparatus;

a registration structure configured to facilitate a predetermined orientation between the first and second portions of the support structure, wherein the registration structure comprises a groove and a tongue configured to be at least partially received by the groove; and a plurality of die members movably attached to the support structure and radially arranged about an axis of the crimping apparatus.

11. The crimping apparatus of claim 10, further comprising a connecting structure configured to permit mounting of the crimping apparatus to a crimping machine to substantially inhibit a relative movement between the crimping apparatus and a portion of a crimping machine along a direction that is substantially parallel to an axis of the crimping apparatus.

12. The crimping apparatus of claim 11, wherein the connecting structure is further configured to permit dismounting of the crimping apparatus from a crimping machine by permitting a relative movement between the crimping apparatus and a portion of a crimping machine along a direction that is substantially perpendicular to the axis of the crimping apparatus.

13. The crimping apparatus of claim 11, wherein the connecting structure comprises a first connecting member and a second connecting member, wherein the first portion of the support structure is provided with the first connecting member and the second portion of the support structure is provided with the second connecting member.

14. A crimping apparatus for use with a crimping machine, the crimping apparatus comprising:

a support structure including a first portion and a second portion, wherein the second portion is assembled with the first portion such that the second portion is not hingedly connected to the first portion and the second portion engages the first portion to define an axial passage into an interior area of the crimping apparatus and wherein the second portion is configured to be disassembled from the first portion such that the second portion is moved with respect to the first portion to selectively define an alternative passage into the interior area of the crimping apparatus;

a registration structure configured to facilitate a predetermined orientation between the first and second portions of the support structure, wherein the registration structure comprises a groove and a tongue configured to be at least partially received by the groove; and a plurality of die members movably attached to the support structure and radially arranged about an axis of the crimping apparatus.

15. The crimping apparatus of claim 14, further comprising a connecting structure configured to permit mounting of the crimping apparatus to a crimping machine to substantially inhibit a relative movement between the crimping apparatus and a portion of a crimping machine along a direction that is substantially parallel to an axis of the crimping apparatus.

* * * * *

UNITED STATES PATENT AND TRADEMARK OFFICE

CERTIFICATE OF CORRECTION

PATENT NO. : 7,497,106 B2
APPLICATION NO. : 11/353383
DATED : March 3, 2009
INVENTOR(S) : Michael P. Beining It is certified that error appears in the above-identified patent and that said Letters Patent is hereby corrected as shown below:

In the Specification, column 4, line 55, please replace the phrase "structures 10" with the phrase --structures 110--.

In the Specification, column 7, line 9, please delete the comma "," after the word "FIGS." and before the number "1".

In the Specification, column 9, line 40, please delete the period "." after the word "corresponding" and before the word "one".

In the Specification, column 11, line 4, please replace the number "6f" with the word --of--.

Signed and Sealed this

Twenty-sixth Day of May, 2009

John Doll

JOHN DOLL
*Acting Director of the United States Patent and Trademark Office*